US005197771A

United States Patent [19]

Kaup et al.

[11] Patent Number: 5,197,771

[45] Date of Patent: Mar. 30, 1993

[54] LOCKING SYSTEM

[75] Inventors: Ludger Kaup, Everswinkel; Renate Berning, Ostbevern, both of Fed. Rep. of Germany

[73] Assignee: Aug. Winkhaus GmbH & Co. KG, Telgte, Fed. Rep. of Germany

[21] Appl. No.: 686,022

[22] Filed: Apr. 12, 1991

[30] Foreign Application Priority Data

Aug. 31, 1990 [EP] European Pat. Off. ..... 90116771.8

[51] Int. Cl.[5] ..... E05C 9/04

[52] U.S. Cl. ..... 292/45; 292/DIG. 21

[58] Field of Search ..... 292/190, 39, 36, 45, 292/41, 35, 34, DIG. 21

[56] References Cited

U.S. PATENT DOCUMENTS

| | | | |
|---|---|---|---|
| 1,368,141 | 2/1921 | Hagstrom | 242/41 X |
| 2,708,301 | 5/1955 | Wilkerson | 292/45 X |
| 2,721,092 | 10/1955 | Simmons | 292/172 |
| 5,058,938 | 10/1991 | Döring et al. | 242/45 |

FOREIGN PATENT DOCUMENTS

| | | | |
|---|---|---|---|
| 195288 | 1/1958 | Austria . | |
| 0168001 | 1/1986 | European Pat. Off. . | |
| 0182751 | 5/1986 | European Pat. Off. . | |
| 0359284 | 3/1990 | European Pat. Off. . | |
| 237667 | 8/1911 | Fed. Rep. of Germany . | |
| 251074 | 9/1912 | Fed. Rep. of Germany . | |
| 401660 | 9/1924 | Fed. Rep. of Germany . | |
| 690168 | 3/1940 | Fed. Rep. of Germany . | |
| 16986 | 2/1982 | Fed. Rep. of Germany . | |
| 1031177 | 5/1958 | Fed. Rep. of Germany | 292/41 |
| 1060285 | 6/1959 | Fed. Rep. of Germany . | |
| 1062143 | 7/1959 | Fed. Rep. of Germany . | |
| 1247171 | 8/1967 | Fed. Rep. of Germany . | |
| 1292034 | 4/1969 | Fed. Rep. of Germany . | |
| 1907061 | 9/1969 | Fed. Rep. of Germany . | |
| 2010068 | 9/1971 | Fed. Rep. of Germany . | |
| 2500589 | 7/1976 | Fed. Rep. of Germany . | |
| 2914372 | 10/1980 | Fed. Rep. of Germany . | |
| 2914377 | 10/1980 | Fed. Rep. of Germany . | |
| 3139574 | 4/1983 | Fed. Rep. of Germany . | |
| 3417054 | 11/1985 | Fed. Rep. of Germany . | |
| 8210306 | 1/1986 | Fed. Rep. of Germany . | |
| 3605826 | 8/1987 | Fed. Rep. of Germany . | |
| 8804522 | 7/1988 | Fed. Rep. of Germany . | |
| 8808757 | 10/1988 | Fed. Rep. of Germany . | |
| 449928 | 3/1913 | France . | |
| 1261221 | 4/1961 | France . | |
| 1346283 | 11/1963 | France . | |
| 2427450 | 12/1979 | France . | |
| 2451441 | 10/1980 | France . | |
| 2563266 | 10/1985 | France . | |
| 174580 | 4/1935 | Switzerland . | |
| 294220 | 1/1954 | Switzerland . | |
| 197475 | 12/1922 | United Kingdom . | |
| 631538 | 9/1948 | United Kingdom . | |
| 2095788 | 10/1982 | United Kingdom . | |
| 2150629 | 7/1985 | United Kingdom . | |

*Primary Examiner*—Richard E. Moore
*Attorney, Agent, or Firm*—Anderson Kill Olick & Oshinsky

[57] ABSTRACT

A window or a door comprises a stationary frame and two leaf frames. The leaf frames are mounted for pivoting movement about mutually parallel pivot axes. A first leaf frame is intended for more frequent opening and closing, and a second leaf frame is intended for less opening and closing. The second leaf frame can be locked with respect to the stationary frame by drive rods which move in opposite sense and which engage the stationary frame at the respective ends thereof. The first leaf frame is provided with the vertical height of the first leaf frame. This first drive rod is driven by a first drive mechanism. The first drive rod controls transverse bolts for engagement with the second leaf frame. The transverse bolts driven by the first drive rod are located outside the first drive mechanism.

19 Claims, 18 Drawing Sheets

LOCKING SYSTEM

BACKGROUND OF THE INVENTION

A window or a door comprises a stationary frame and two leaf frames mounted on this frame so that they pivot about mutually parallel pivot axis. A first leaf frame of these two leaf frames is intended for frequent pivoting movement about a first pivot axis betwen an open position and a closed position. A second leaf frame is intended for less frequent pivoting movement about a second pivot axis between a closed position and an open position. Both leaf frames comprise, remote from the associated pivot axis a leaf frame member the first leaf frame having a first leaf frame member, and the second leaf frame having a second leaf frame member. The first leaf frame member and the second leaf frame member are in the closed position of the associated leaf frames directly opposite each other, i.e. without the interposition of an intermediate member which is rigid with the outer frame. The second leaf frame is in the region of the second leaf frame member lockable by second locking means on transverse members of the frame which extend substantially at right-angles to the first and second leaf frame members. The first leaf frame is lockable in the region of the first leaf frame member by first locking means at the second leaf frame member. The locking system comprises, mounted on the second leaf frame member between the two transverse members a second gear unit. A second drive rod assembly is mounted on and parallel with the second leaf frame member and has two second drive rod elements adapted for movement in opposition to each other and parallel with the second leaf frame member as a result of actuation of the second gear unit. Second drive rod end bolts are provided on both second drive rod elements for engagement in corresponding second drive rod end bolt housings on the two transverse members. The said locking system furthermore comprises a first gear unit mounted on the first leaf frame member between the two transverse members. By reason of the first gear unit, transverse latch means are controlled. These transverse latch means have at least one transverse latch crossing a leaf frame gap such as to engage transverse latch housing means which can be provided on the second leaf frame member. The first gear unit further controls transverse bolt means crossing the leaf frame gap such as to engage bolt housing means which can be provided on the second leaf frame member.

THE PRIOR ART

Known from DE-PS 29 14 377 is a locking system of the type mentioned above in which the first gear unit controls a transverse latch and a transverse thrust bolt. To lock the first leaf frame which is opened more frequently, on the second leaf frame which is opened less frequently or on the second leaf frame member, the transverse latch and the transverse thrust bolt respectively engage a transverse thrust bolt housing and transverse latch housing disposed on the second leaf frame member. The first leaf frame is therefore locked on the second leaf frame only by the transverse latch and the transverse thrust bolt. If, when in the installed condition, the leaf frames are of relatively considerable height, then in their and portions, i.e. in the vicinity of the transverse members of the frame, the two leaf frames cannot close sufficiently tightly any longer by virtue of distortion or dimensional deviation. Apart from the draughts which may possibly result and which are disturbing, a considerable amount of heart may leak out through the gap occurring between the first and second leaf frames and find its way into the environment and, on the other hand, there is the possibility of unauthorised persons inserting tools and opening one or both leaf frames by force. Furthermore, in the case of the locking system disclosed in DE-PS 29 14 377, the second drive rod elements of the second drive rod assembly are disposed at a relatively great distance from the associated face plate. This has the effect that a sufficiently deep groove has to be cut into the second leaf frame member which entails a relatively substantial labour cost. Furthermore, the second leaf frame member has to be of sufficiently thick material. Furthermore, there is provided on one of the two second drive rod elements of the second drive rod assembly a curved member intended to prevent locking of the first leaf frame when the second leaf frame is still not locked. The mounting and manufacture of this curved member entails an additional working step, so that the manufacturing process and assembly of this prior art locking system is altogether relatively substantial.

OBJECT OF THE INVENTION

A main object of the present invention is to provide a locking system of the above-described type which, while being of simple construction, guarantees a sealing-tight non-twisting closure of the two leaf frames over the length of their leaf frame members.

SUMMARY OF THE INVENTION

In consideration of this main object a locking system is provided for a window or door. This window or door comprises a stationary frame and two leaf frames mounted on this frame so that they pivot about mutually parallel pivot axis. A first leaf frame of these two leaf frames is intended for frequency pivoting movement about a first pivot axis between an open position and a closed position. A second leaf frame is intended for less frequency pivoting movement about a second pivot axis between a closed position and an open position. Both leaf frames comprise, remote from the associated pivot axis of leaf frame member, the first leaf frame having a first leaf frame member and the second leaf frame having a second leaf frame member. The first leaf frame member and the second leaf frame member are in the closed position of the associated leaf frames directly opposite each other, i.e. without the interposition of an intermediate member which is rigid with the other frame. The second leaf frame is in the region of the second leaf frame member lockable by second locking means on transverse members of the frame which extend substantially at right-angles to the first and second leaf frame members. The first leaf frame is lockable in the region of the first leaf frame member by first locking means at the second leaf frame member. The locking system comprises, mounted on the second leaf frame member between the two transverse members, a second gear unit. A second drive rod assembly is mounted on and parallel with the second leaf frame member and has two second drive rod elements adapted for movement in opposition to each other and parallel with the second leaf frame member as a result of actuation of the second gear unit. Second drive rod end bolts are provided on both second drive rod elements for engagement in corresponding second drive rod and bolt housings on the two transverse members. The said locking system furthermore comprises a first gear unit mounted on the first leaf frame member between the two transverse members. By reason of the first gear unit, transverse latch means are controlled. These transverse latch means have at least one transverse latch crossing a leaf frame gap such as to engage transverse latch housing means which can be provided on the second leaf frame member. The first gear unit further controls transverse bolt means crossing the leaf frame gap such as to engage bolt housing means which can be provided on the second leaf frame member.

On the first leaf frame member there is provided a first drive rot assembly extending over a major part of the length of the first leaf frame member. This first drive rod assembly is adapted for movement by the first gear unit in the longitudinal direction of the first leaf frame member. The transverse bolt means comprise a plurality of transverse bolts controlled by the first drive rod assembly and are situated outside the first gear unit.

The invention makes it possible for both leaf frames to be so locked together over the total length of their leaf frame members. There is no gap and none of the disadvantages mentioned above. The transverse bolts disposed outside the first gear unit are easily controlled by the first drive rod assembly. Inter alia, this makes it possible for the entire locking system to be of modular construction. Individual sub-assemblies or component units as such, for example, the first and second drive rod assembly as well as the first and second gear units, can be derived from respective basic components.

The transverse bolts may be of the quite different types. It is particularly advantageous if the drive rod controlled transverse bolts are constructed as pivoting transverse bolts which are pivotable about an axis which is substantially at right-angles to a leaf plane of the first leaf frame. In their inoperative position, the transverse bolts can thereby be sufficiently retracted into the leaf frame member that they are no longer visible from outside.

Basically, it is possible for the transverse bolts to comprise transverse bolts which are disposed solely outside the first gear unit. It is however equally conceivable for the transverse bolt means to comprise at least one transverse thrust bolt which is disposed in the region of the first gear unit.

In order to prevent the first leaf frame being locked before the second leaf frame is locked, it is possible furthermore to envisage that of the transverse latch housing means and the transverse bolt housing means at least one part is controllable by the second drive rod elements in an entrance locking condition, so that in a release position of the second drive rod elements in which the second drive rod end bolts are withdrawn from the second drive rod end bolt housings, the transverse latch means or transverse bolt means cannot be controlled so that they enter the associated transverse latch housing means or transverse bolt housing means.

This can be achieved in that the second drive rod elements bear directly on the transverse latch housing means or transverse bolt housing means. If the second leaf frame is as yet not locked, then in their unlocked position the second drive rod elements prevent insertion of the at least one part of the transverse latch means and of the transverse bolt means.

Basically, it is possible for the first and second gear units to be disposed at any desired location between the transverse members of the frame. Since the first and second gear units are actuated by outwardly visible actuating elements, such as for example a catch or a door knob or a push button, it is for optical reasons particularly advantageous if the first gear unit and the second gear unit are disposed to be aligned with each other in the direction of a connecting line at right-angles to the first and second pivot axes.

The second drive rod elements of the second gear unit are moved in opposite directions for locking and unlocking the drive rod end bolts of the second drive rod elements. This can be accomplished on the one hand by two different actuating elements. In order to achieve actuation of the second drive rod elements with only one single actuating element, it is furthermore proposed that the second gear unit be constructed with a reversing transmission between the two drive rod elements.

So that the first drive rod assembly is of particularly simple construction, it is furthermore suggested that the first drive rod assembly comprises a single first drive rod or two first and always equidirectional movable drive rod elements.

In order to prevent opening of one or of both leaf frames by an unauthorised person, it is possible furthermore to provide for at least the first gear unit comprise a first locking arrangement which permits locking of the first drive rod assembly in a locked position in which the transverse latch means and the transverse bolt means are controlled to be within the transverse latch housing means and the transverse bolt housing means. To increase safety, it is possible furthermore to provide for the second gear unit to comprise a second locking arrangement which permits locking of the second drive rod assembly in a locked position in which the second drive rod end bolts are inserted into the second drive rod end bolt housings of the transverse members. It is possible thereby for the locking device to be constructed so that it can be locked by a locking cylinder.

The first gear unit can be of entirely different types of construction. A particularly advantageous construction is achieved if the first gear unit is constructed with a housing with, mounted to rotate in the housing about an axis at right-angles to the plane of the first leaf frame, a follower rotatable by a push button or knob. A return spring prestresses the follower into a rest position so that it can be rotated in opposite directions out of this rest position. The first drive rod assembly is guided along a face plate of the housing. For connecting the follower to the first drive rod assembly, a transmission linkage is provided which is subject to backlash. This transmission linkage includes a transmission lever for displacement of the first drive rod assembly. Rotation of the follower in a first direction of rotation serves to displace the first drive rod assembly into a locked position and rotation of the follower in a second direction of rotation serves to displace the first drive rod assembly into an open position. The backlash in the transmission linkage after entering the relevant drive rod position permits, upon release of the push button or knob, a return of the follower to its reset position by the return spring, leaving the first drive rod assembly in whichever extreme drive pod position had been reached.

The transmission linkage comprises a control element which is guided in the vicinity of, opposite the face plates, a boundary edge of the housing parallel with the first drive rod assembly. This control element is furthermore coupled in substantially clearance free manner to the follower. The return spring further engages the control element. The transmission lever is constructed as a two-armed transmission lever which is mounted on the housing at a midway location between the first drive rod assembly and the control element. A first shorter lever arm engaging the control element with backlash and a longer lever arm engages the first drive rod assembly. The follower acts on at least one transverse latch of the transverse latch means which is prestressed by a latch spring in the direction of a closing position. The first drive rod assembly is coupled to a transverse thrust bolt which is guided for displacement at right-angles to the face plate in the housing and which is adapted for movement between a closed position corresponding to the locked position of the first drive rod assembly and a retracted position corresponding to the open position of the first drive rod assembly. It is possible to mount on the housing a first locking arrangement which makes it possible to lock displacement of the first drive rod assembly out of its locked position into its open position. Thus, the first gear unit is of extremely compact and space-saving construction. In addition, this makes it suitable as a basic element of a module from which further gear units can be derived.

In order to simplify manufacture of the first and second gear units, it is possible furthermore for the second gear unit to be derived from the first gear unit, while retaining the housing, the associated face plate, the follower, the return spring, the control element and the transmission lever while leaving out the transverse latch and the transverse thrust bolt. The transmission can engage then one of the two second drive rod elements, this second drive rod element is connected to the other drive rod element by a motion reversing gear mechanism. In such a case, the motion reversing gear can be disposed outside the second gear unit.

It is possible further to simplify the construction of the locking system according to the invention if the openings in the face plate of the second gear unit which are not filled due to the omission of the transverse latch and transverse thrust bolt are used as housings for the transverse latch and the transverse thrust bolts controlled by the first gear unit. Consequently, providing housings for the transverse latch and the transverse thrust bolt of the first gear unit on the second leaf frame becomes unnecessary.

The construction of a locking system can also be simplified if matching face plates are associated with the first drive rod assembly and the second drive rod assembly. The pivot bolt openings in the face plate of the first drive rod assembly are occupied by pivot bolts whereas the openings in the face plate of the second drive rod assembly which are accordingly not occupied by pivot belts serve as bolt housings for the pivot bolts of the first drive rod assembly.

In order to be able to fit and the first and second gear units on different face plate drive rod assemblies, it is furthermore suggested that the first and second gear units each be separably connected to a face plate-drive rod assembly.

The housing means for the transverse latch means and the transverse bolt means can be provided in the second leaf frame member. To this end, it is necessary to provide at the corresponding location a plurality of depressions into which catch means and bolt means engage when the first leaf frame is in the locked condition. To produce the housings, it is possible for example to provide a multiple-milling tool capable of producing a plurality of housings simultaneously. Manufacture can however be simplified in that on an edge face of the second leaf frame which is towards the first leaf frame a strip is fitted on which are provided the housing means for the transverse latch means and the transverse bolt means of the first leaf frame. The strip can be prefabricated and mounted on the leaf frame only during final fitment thereof. This makes it is possible in turn to use different strips to suit whatever are the current requirements. In addition, it means there is a possibility of the leaf frames being constructed so that they are identical, only the strip for example causing them to differ and become first or second leaf frames.

In order to achieve reliable locking of the two leaf frames, it is possible to envisage mounting on the strip closure plates behind which pivot bolts of the first leaf frame can engage.

The various features of novelty which characterize the invention are pointed out with particularity in the claims annexed hereto and forming apart of the disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

The invention will be explained in greater detail hereinafter with reference to an embodiment shown in the accompanying drawings in which.

DETAILED DESCRIPTION OF THE PREFERRED EMBODIMENTS

Figure 1A:
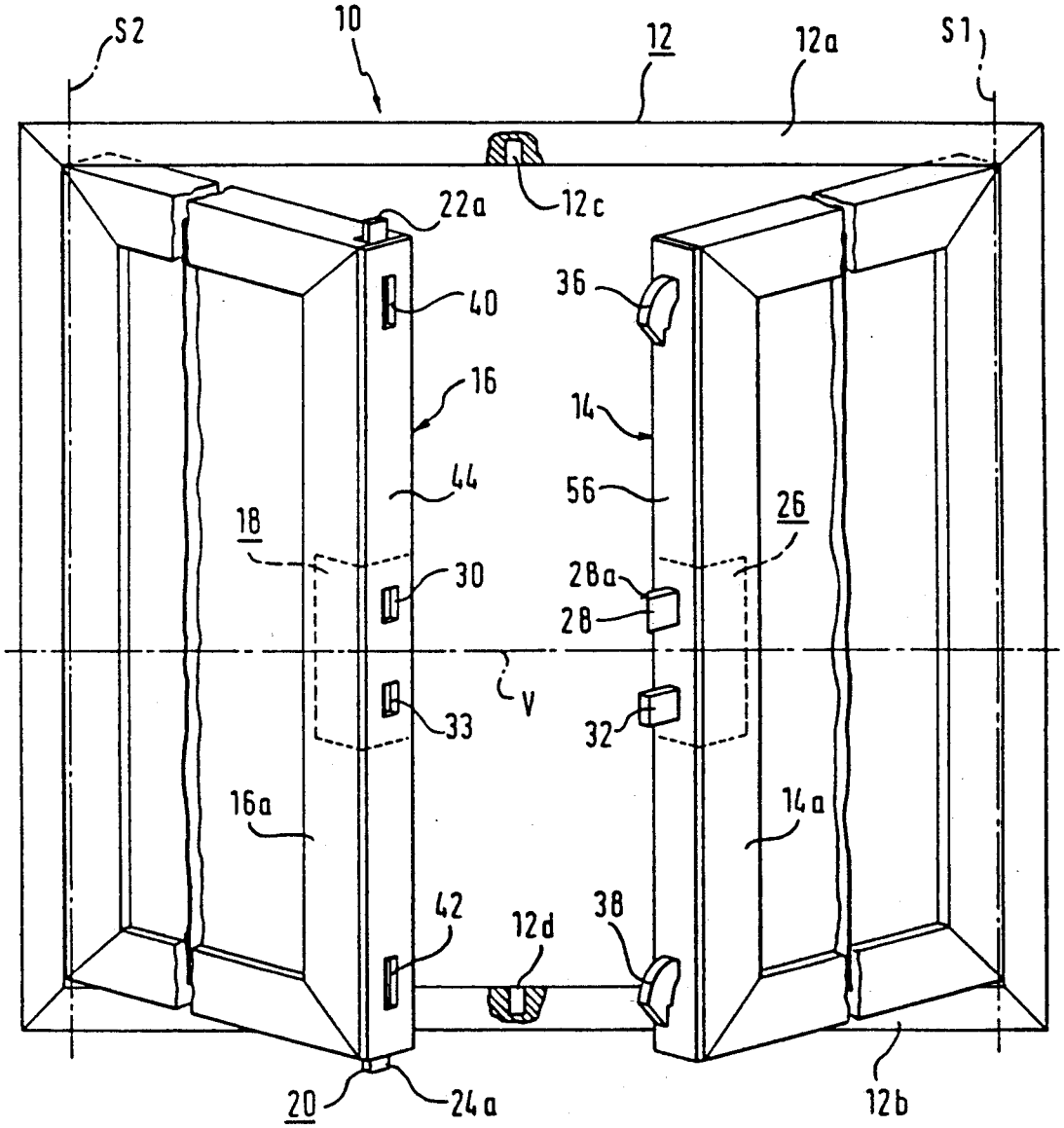
FIG. 1*a* is a perspective view of a double leaf window with a first outwardly pivoted leaf frame.

FIGS. 1*a* shows a double leaf window 10 with a diagrammatically shown locking system according to the invention. The double leaf window 10 comprises a window frame forming a stationary frame 12 and, mounted on this frame 12 to pivot about mutually parallel pivot axes S1, S2, two leaf frames 14, 16. Of these two leaf frames 14, 16, the first leaf frame 14 is intended for frequent pivoting movement about a first pivot axis S1 between a closed position in which the two leaf frames 14, 16 lie one on the other in sealing-tight fashion, and an open position in which the leaf frames 14, 16 are separate from each other, whereas the second leaf frame 16 is intended for less frequent pivoting movement about the second pivot axis S2 between the closed position and the open position. It goes without saying that the first and second leaf frames 14, 16 may be moved from the open position and back into the closed position. In FIGS. 1*a*, *b* the first and second leaf frames 14, 16 are shown in a half open position.

Figure 1B:
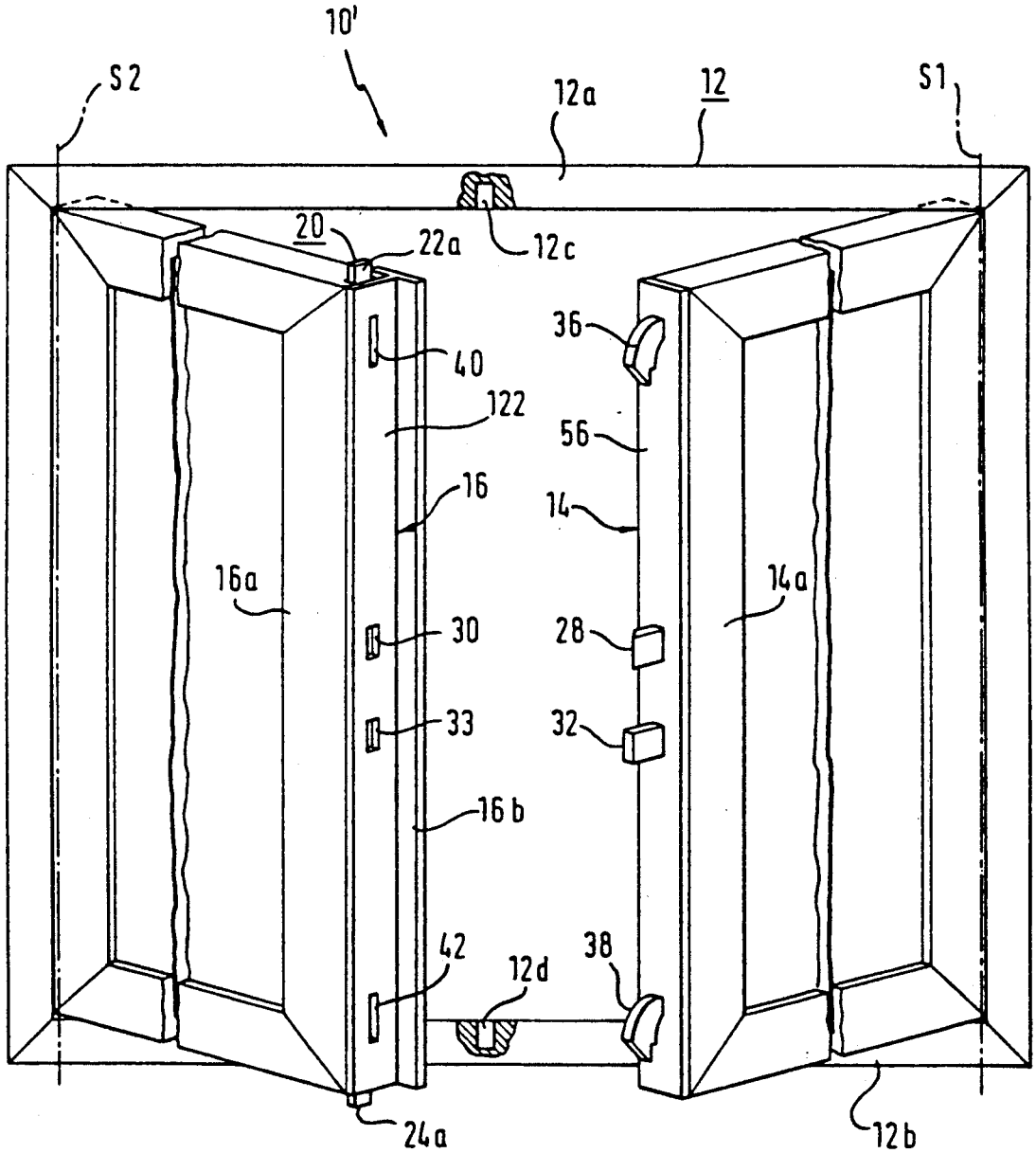
FIG. 1*b* is a modified form of FIG. 1*a;*

FIGS. 1*b* shows a modified embodiment in which a gap closing strip 16*b* is fastened to the leaf frame 16.

The two leaf frames 14, 16 each have leaf frame members 14*a*, 14*b* which are remote from the associated pivot axes S1, S2, the leaf frame member of the first leaf frame 14 being described as the first leaf frame member 14*a* and the leaf frame member of the second leaf frame 16 being described as the second leaf frame member 16*a*. The first leaf frame member 14*a* and the second leaf frame member 16*a*, in the closed position on the leaf frames 14, 16, are directly opposite each other, i.e. without any interposed intermediate member which is rigid with the surrounding frame.

Figure 2A:
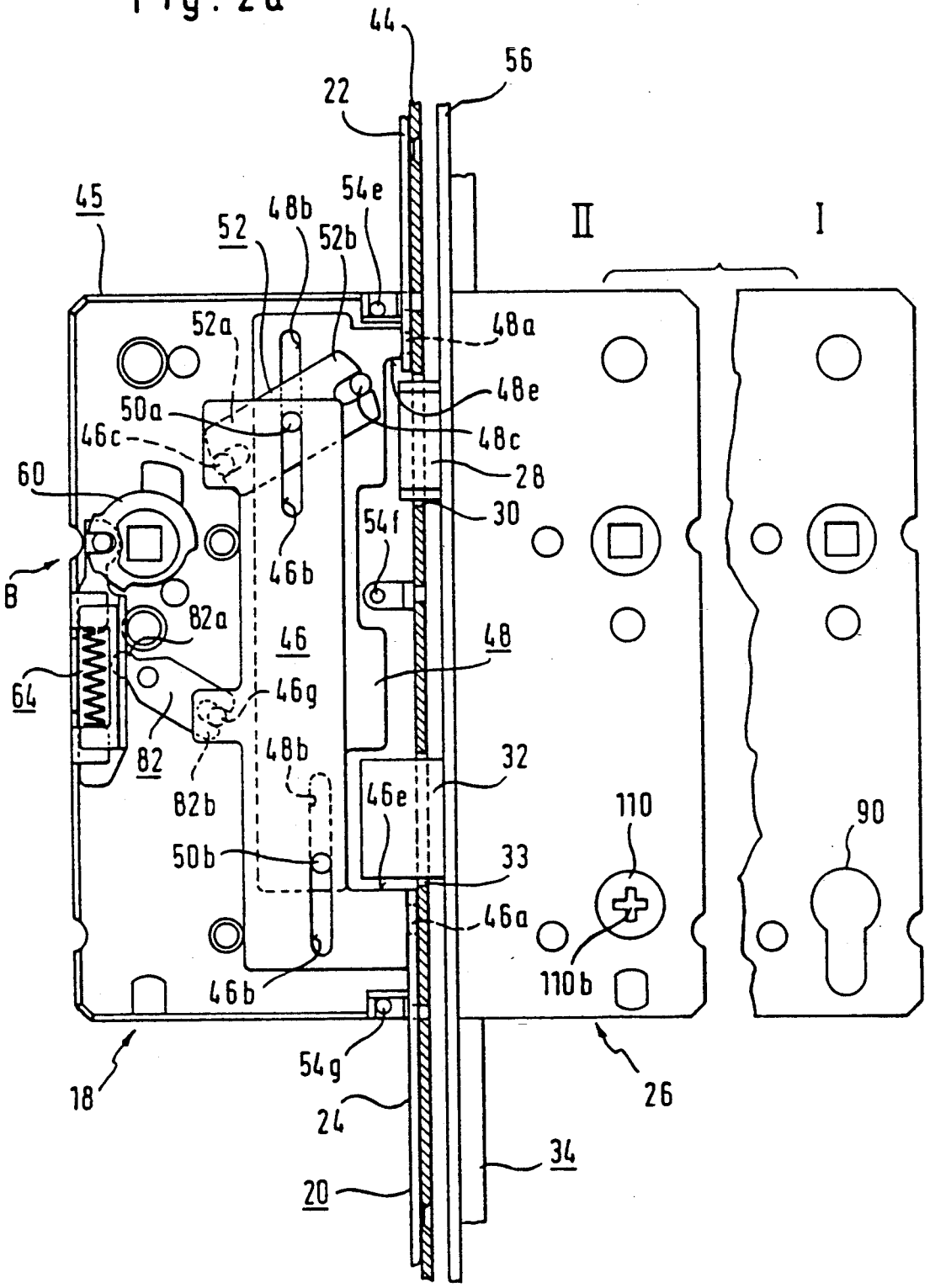
FIGS. 2*a, b* show a first embodiment of locking system according to the invention with a concealed first gear unit and an opened second gear unit as well as a first and a second drive rod assembly, the first and second gear units and the first and second drive rod assemblies being in their interlocked positions.
Figure 3A:
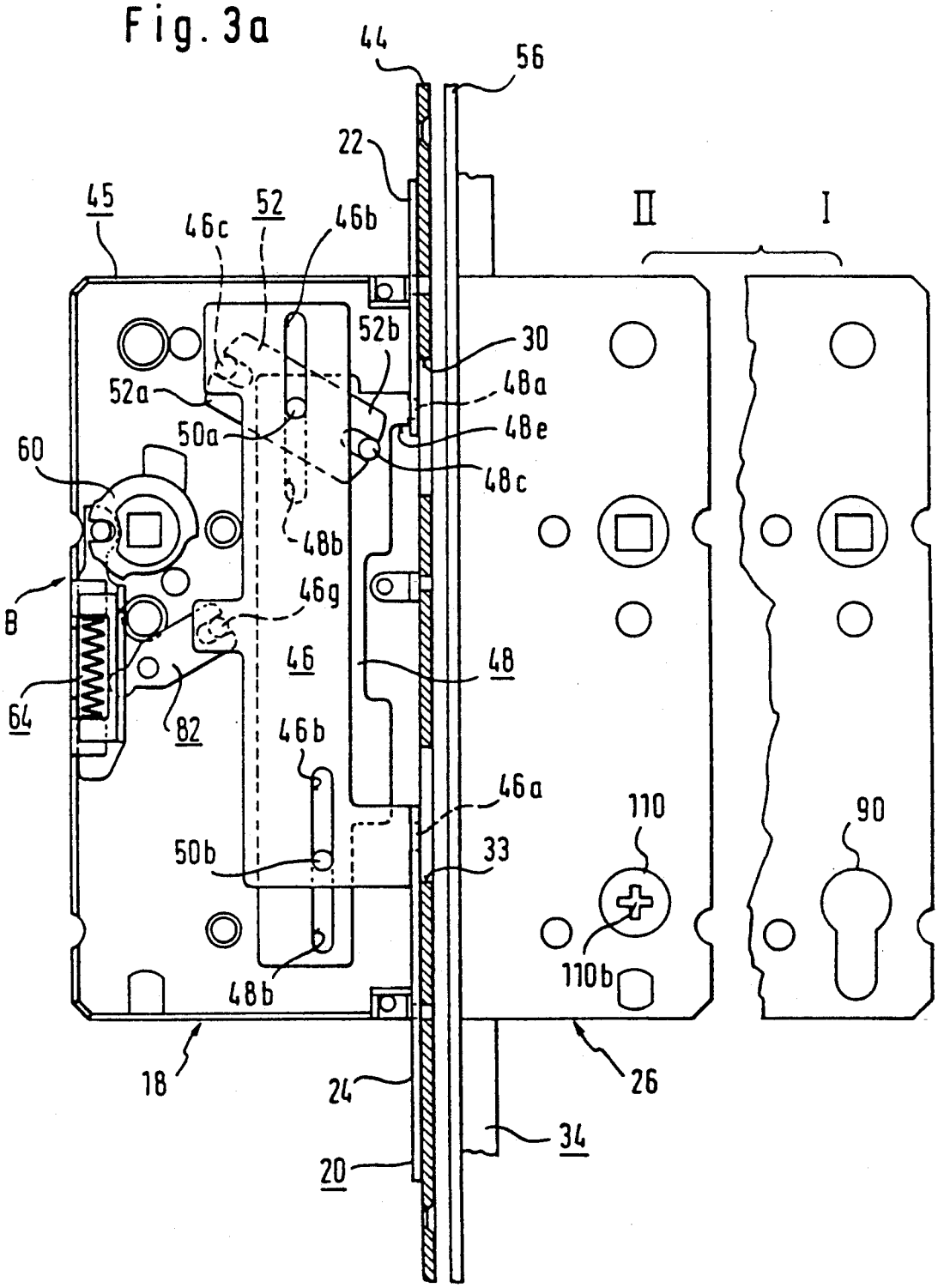
FIGS. 3*a, b* are a view of the locking system according to FIGS. 2*a, b,* the first and second gear units and the first and second drive rod assemblies being in their open position.

The locking system shown in FIG. 1*a* comprises a second gear unit 18 provided in the second leaf frame member 16*a* between two transverse members 12*a*, *b* of the frame 12 and mounted in and parallel with the second leaf frame member 16*a* and extending over virtually the entire length of the second leaf frame member 16*a*, a second drive rod assembly 20 with two second drive rods 22, 24 adapted to be moved by the second gear unit 18 in opposite directions and parallel with the second leaf frame member 16*a*, and a second drive rod end bolt 22*a*, 24*a* respectively on each of the two outer ends of the drive rods 22, 24 which can be engaged in corresponding drive rod end bolt housings 12*c*, *d* in the two transverse members 12*a*, *b* of the frame 12 (see also FIGS. 2*a*, 3*a*). The locking system furthermore comprises, fitted in the first leaf frame member 14*a* between the two transverse members 12*a*, *b* of the frame 12, a first gear unit 26 which controls a transverse latch 28 disposed in the first gear unit 26 and adapted to engage over a leaf frame, so that it engages a transverse latch housing 30 which can be provided on the second leaf frame member 16*a*. Furthermore, there is in the first gear unit 26 and likewise engaging over a leaf frame a transverse thrust bolt 32 which is controlled by the first gear unit 26. In the locked condition of the first leaf frame 14, the transverse latch 28 and the transverse thrust bolt 32 engage housings 30, 33 provided on the second leaf frame 16, the transverse latch 28, upon closure of the first leaf frame 14 and after precedent closure of the second leaf frame 16, has its oblique surface 28*a* automatically pushed back against spring force so that it can then snap into the transverse latch housing 30 while the transverse thrust bolt 32, after the first leaf frame 14 has been completely closed, can be pushed into the transverse bolt housing 33 by actuation of the first gear unit 26.

Furthermore, the first gear unit 26 controls a first drive rod assembly 34 which extends over virtually the entire length of the first leaf frame member 14*a*. This first drive rod assembly 34 controls, in relation to FIGS. 1*a* and 2*a*, transverse bolts 36, 38 constructed as pivot bolts which are disposed at the top and bottom of the first gear unit 26 and which are adapted to engage over the leaf frame. When the first leaf frame 14 is locked together with the second leaf frame 16, the pivot bolts 36, 38 engage pivot bolt housings 40, 42 provided in the second leaf frame member 16 so that the first leaf frame 14 is locked together with the second leaf frame 16 via the transverse latch 28, the transverse thrust bolt 32 and the pivot bolts 36, 38. By reason of the more or less even distribution of the pivot bolts 36, 38 together with the transverse thrust bolts 32, it is ensured that there is no gap between the first and second leaf frames 14, 16 in their closed position and in that they are sufficiently securely locked to each other over the total length of their leaf frame members 14*a*. 16*a*.

Figure 2B:
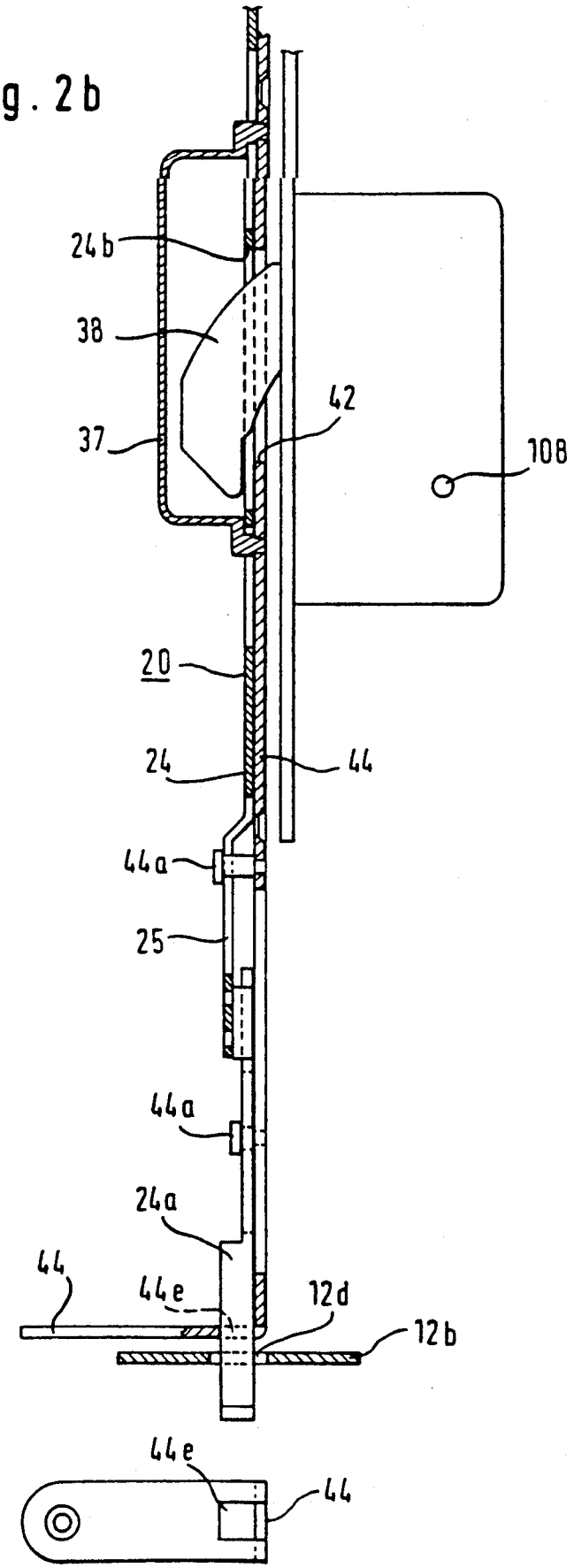

As FIGS. 2*a* and 2*b* show, the second drive rod assembly 20 with its two drive rods 22, 24 is guided on a face plate 44 which is provided rigidly on the second leaf frame member 16*a*, by means of guide studs 44*a* rigid with the face plate 44 (see FIG. 2*b*). For this purpose, the two drive rods 22, 24 comprise longitudinal slots 25 which are transversed by the guide studs 44*a*. Furthermore, the guide studs 44*a* have widened heads so that the drive rods 22, 24 have their flat side bearing closely against the face plate 44. The face plate 44 provided on the second leaf frame member 16*a* has ends angled over by about 90° (see FIG. 2*b*) by means of which it is likewise fixed on the second leaf frame member 16*a*.

As FIGS. 1*a*, 2*a* and 3*a* show, the second gear unit 18 and the first gear unit 26 are aligned with each other in the direction of a connecting line V at right-angles to the first and to the second pivoting axes S1, S2. The housing 30 for the transverse latch 28 and the housing 33 for the transverse thrust bolt 32 are in this case formed on the second gear unit 18. So that the transverse latch 28 and the transverse thrust bolt 32 can enter the second gear unit 18, the face plate 44 has at the level of the second gear unit 18 apertures 30 and 33 the dimensions of which correspond to the sizes of the transverse latch 28 and of the transverse thrust bolt 32. The housings 40, 42 for the pivot bolts 36, 38 disposed outside the first gear unit 26 are formed by pockets 37 which are rigidly disposed on the face plate 44 (see FIG. 2*b*). For locking of the first leaf frame 14 on the second leaf frame 16, so that the pivot bolts 36, 38 can pivot into the housings 40, 42, the face plate 44 comprises slot-like apertures 40, 42. In addition, the two drive rods 22, 24 of the second drive rod assembly 20 are likewise provided with longitudinal slots 24*b*. The pivot bolts 36, 38 are thereby so constructed that in the locked condition they engage behind the face plate 44 (see FIG. 2*b*).

As FIG. 2*a* shows, the two drive rods 22, 24 of the second drive rod assembly 20 are actuated via two slide members 46, 48 disposed one behind the other in a plane extending at right-angles to the plane of the drawing in FIG. 2*a* and provided in a housing 45 in the second gear unit 18. The slide member 46 is at 46*a* rigidly connected to the (in FIG. 2*a*) lower drive rod 24 while the slide member 48 is at 48*a* rigidly connected to the (in FIG. 2*a*) upper drive rod 22. This rigid connection 46*a*, 48*a* can for example be accomplished by a riveted joint. The two slide members 46, 48 are guided substantially parallel with and on the guide bolts 50*a*, *b* which are rigid with the housing and which traverse longitudinal slots 46*b*, 48*b* in the slide members 46, 48. The two slide members 46, 48 are coupled with each other for movement in opposite directions via a double-armed lever 52. For this purpose, the double-armed lever 52 has, on the left in FIG. 2*a*, a bifurcated arm 52*a* and, on the right in FIG. 2*a*, a bifurcated arm 52*b*. The two bifurcated arms 52*a*, 52*b*, each engage around a bolt 46*c*, 48*c* disposed rigidly on one of the slide members 46, 48. The double-armed lever 52 is pivotally mounted on the guide bolt 50*a*. If the slide member 46, by an actuating device B of the second gear unit 18 and which is to be described further below, is displaced in a vertical direction in relation to FIG. 2*a*, then this sliding movement is converted by the double-armed lever 52 into an oppositely directed movement for the slide member 48. Therefore, starting from the open position of the second gear unit 18 which is shown in FIG. 3*a*, upon a displacement of the slide member 46 in relation to FIG. 3*a* downwards by the actuating means B, the drive rod 24 which is rigidly connected to the slide member 46 is likewise displaced downwardly, whereas the slide member 48 and the drive rod 22 which is rigidly connected to it is displaced upwardly. Thus, the two drive rod end bolts 22*a*, 24*a* which are rigidly connected to the drive rods 22, 24 enter the drive rod end bolt housings 12*c*, *d* which are disposed in the transverse members 12*a*, *b* of the frame 12.

Figure 3B:
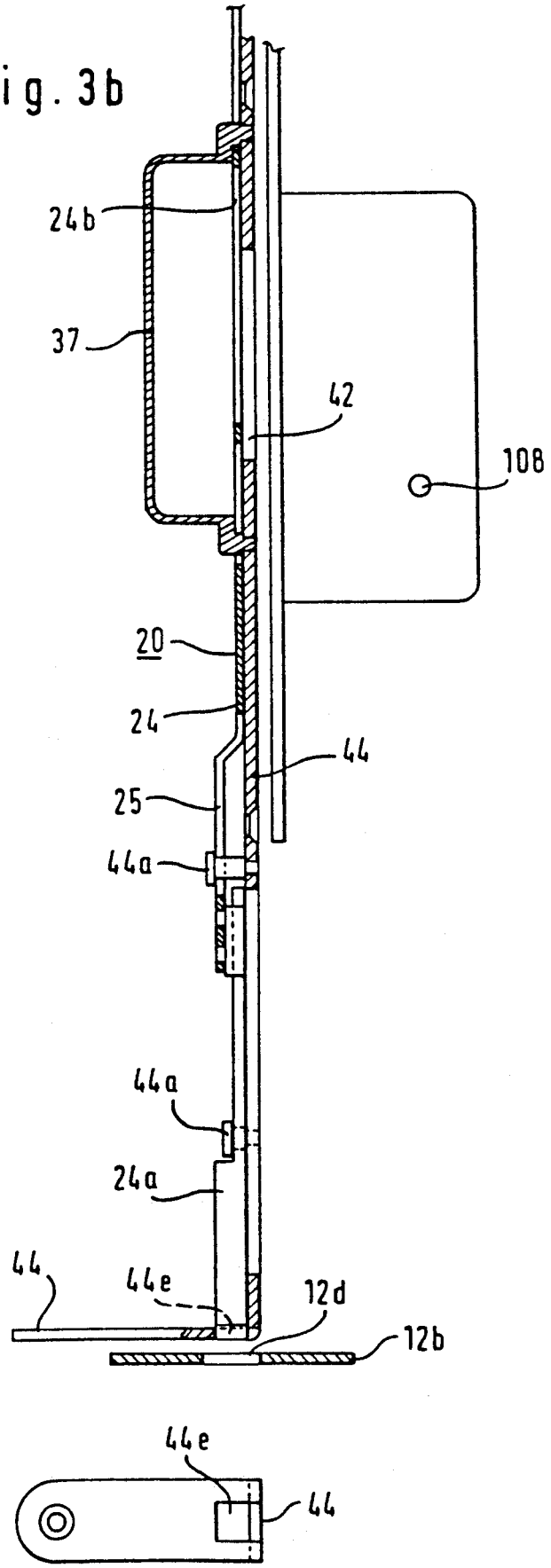

These housings 12*c*, *d* are enclosed by locking plates not shown in greater detail but which are rigidly provided on the two transverse members 12*a*, *b*. So that the drive rod end bolts 22*a*, 24*a* can engage into the housings 12*c*, *d* in the transverse members 12*a*, *b*, the face plate 44 which is angled over in the direction of the pivot axis S2 in the end portion of the drive rods 22, 24 comprises an aperture 44*e* (see FIGS. 2*b*, 3*b*). At the bottom edge of FIGS. 2*b*, 3*b* there is a plan view of the angled over end of the face plate 44.

As FIGS. 3*a*, *b* show, closure of the first leaf frame 14 is impossible if the second leaf frame 16 is not locked, since on the one hand the aperture 30 in the face plate 44 for the transverse latch 28 and the aperture 33 in the face plate 44 for the transverse thrust bolt 32 are at least partially occluded by the two ends of the drive rods 22, 24 which are connected to the transverse slide members 46, 48 at 46*a*, 48*a* and on the other hand the longitudinal slots 40, 42 of the face plate 44 for the pivot bolts 36, 38 are at least partially closed by the drive rods 22, 24. The first leaf frame 14 cannot therefore be locked in this situation.

In order to be able to lock the first leaf frame 14, therefore, it is necessary first to lock the second leaf frame 16. To this end, by actuating the actuating device B of the second gear unit 18, the two slide members 46, 48 are so moved towards each other in opposite directions that the slide member 46 in relation to the FIG. 3*a* is displaced downwardly while the slide member 48 in relation to FIG. 3*a* is displaced upwardly in a substantially vertical direction. Consequently, the two drive rod end bolts 22*a*, 24*a* enter the housings 12*c*, *d* of the transverse members 12*a*, *b* of the frame 12. At the same time, the aperture 30 for the transverse latch 28, the aperture 33 for the transverse thrust bolt 32 and the longitudinal slots 40, 42 for the pivot bolts 36, 38 are exposed. Thus, after the second leaf frame 16 has been locked, the first leaf frame 14 can likewise be locked. For this purpose, it is closed until the first leaf frame member 12*a* is opposite the second leaf frame member 16*a*. Upon closure of the first leaf frame 14, the transverse latch 28 passes through the aperture 30 in the face plate 44 in a manner which is as yet to be described and so penetrates the second gear unit 18. Consequently, the first leaf frame 14 is held fast on the second leaf frame member 16*a* but only for a temporary phase, i.e. by a simple actuation of the actuating device B of the first gear unit 26, the first leaf frame 14 can be readily opened. Then, by an actuation of the first gear unit 26, which will be described hereinafter, the transverse thrust bolt 32 is pushed out so that, passing through the aperture 33 in the face plate 44, it enters the second gear unit 18. At the same time, by an actuation of the first gear unit 26, which will likewise be described hereinafter, and through the agency of the first drive rod assembly 34, the pivot bolts 36, 38 are pivoted outwardly so that, passing through the longitudinal slots 40, 42 they enter the pivot bolt housings 40, 42. Thus, the first leaf frame 14 is rigidly locked to the second leaf frame 16 (see FIGS. 2*a*, *b*).

As FIGS. 2*a*, *b* show, upon a locking of the first leaf frame 14 to the second leaf frame 16, this second leaf frame 16 cannot be unlocked and cannot therefore be opened. This is prevented in that the slide members 46, 48 comprises abutment faces 46*e*, 48*e*. If upon a locking of the first leaf frame 14 to the second leaf frame 16, this second gear unit 19 were to be actuated, then the abutment face 46*e* would strike the (in relation to FIG. 2*a*) lower narrow side of the transverse thrust bolt 32 and the abutment face 48*e* would strike the (likewise in relation to FIG. 2*a*) upper narrow side of the transverse latch 28. It is sufficient for only one of the two slide members 46, 48 to have one of the two abutment faces 46*e*, 46*e*. Naturally, it would however also be conceivable instead of the abutment faces 46*e*, 48*e*, for one of the two drive rods 22, 24 to be so constructed that upon an actuation of the second gear unit 18, it would strike its associated pivot bolt 36, 38. It is however also possible to have a combination in which both the transverse slide members 46, 48 and also the drive rods 22, 24 have abutment faces.

For opening of the second leaf frame 16, therefore, it is necessary first to unlock the first leaf frame 14 and to retract the transverse latch 28. For this purpose, the two pivot bolts 36, 38 are pivoted out of the pivot bolt housings 40, 42 by the actuating device B. At the same time, the transverse thrust bolt 32 is likewise retracted by an actuation of the second gear unit 26. If, then, by a further actuation of the first gear unit 26, the transverse latch 28 is retracted from the second gear unit 18 and from the aperture 30 in the face plate 44, then the first leaf frame 14 can be opened. Now it is also possible to unlock and then open the second leaf frame 16. For this purpose, an actuation of the second gear unit 18 causes the slide member 46 to be displaced upwardly in relation to FIG. 2*a* and the slide member 48 to be moved downwardly likewise in relation to FIG. 2*a*, i.e. the two slide members 46, 48 perform movements in opposite directions. Thus, the drive rods 22, 24 associated with them are likewise displaced upwardly (drive rod 24) and downwardly (drive rod 22). The drive rod end bolt 22*a*, 24*a* associated with the relevant drive rod 22, 24 hereby passes out of the housings 12*c*, *d* in the transverse members 12*a, b* of the frame 12 and the second leaf frame 16 can now be opened.

Figure 4A:
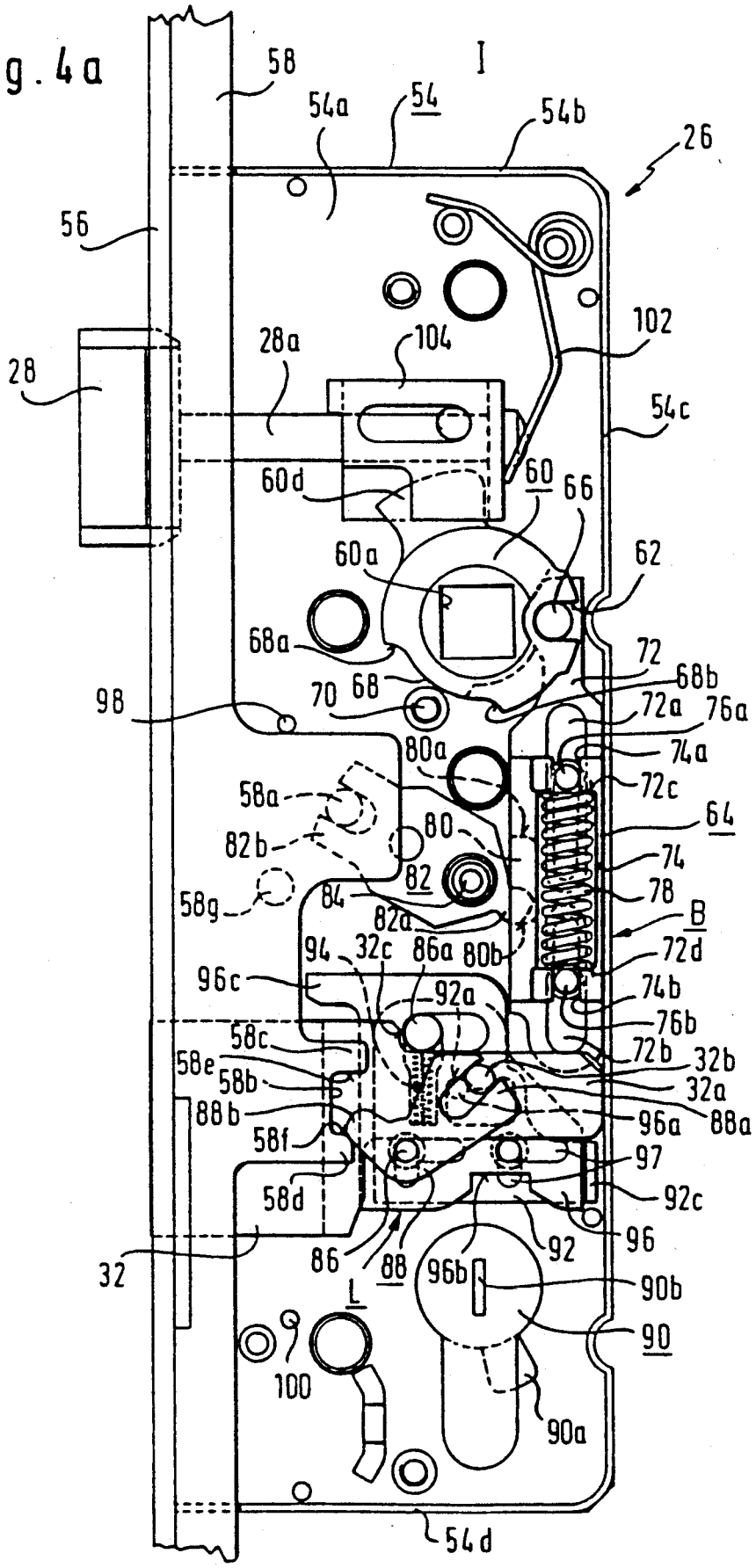
FIGS. 4*a–c* are enlarged views of the opened first gear unit according to FIGS. 2*a–*3*b* in various open and locked position.
Figure 4B:
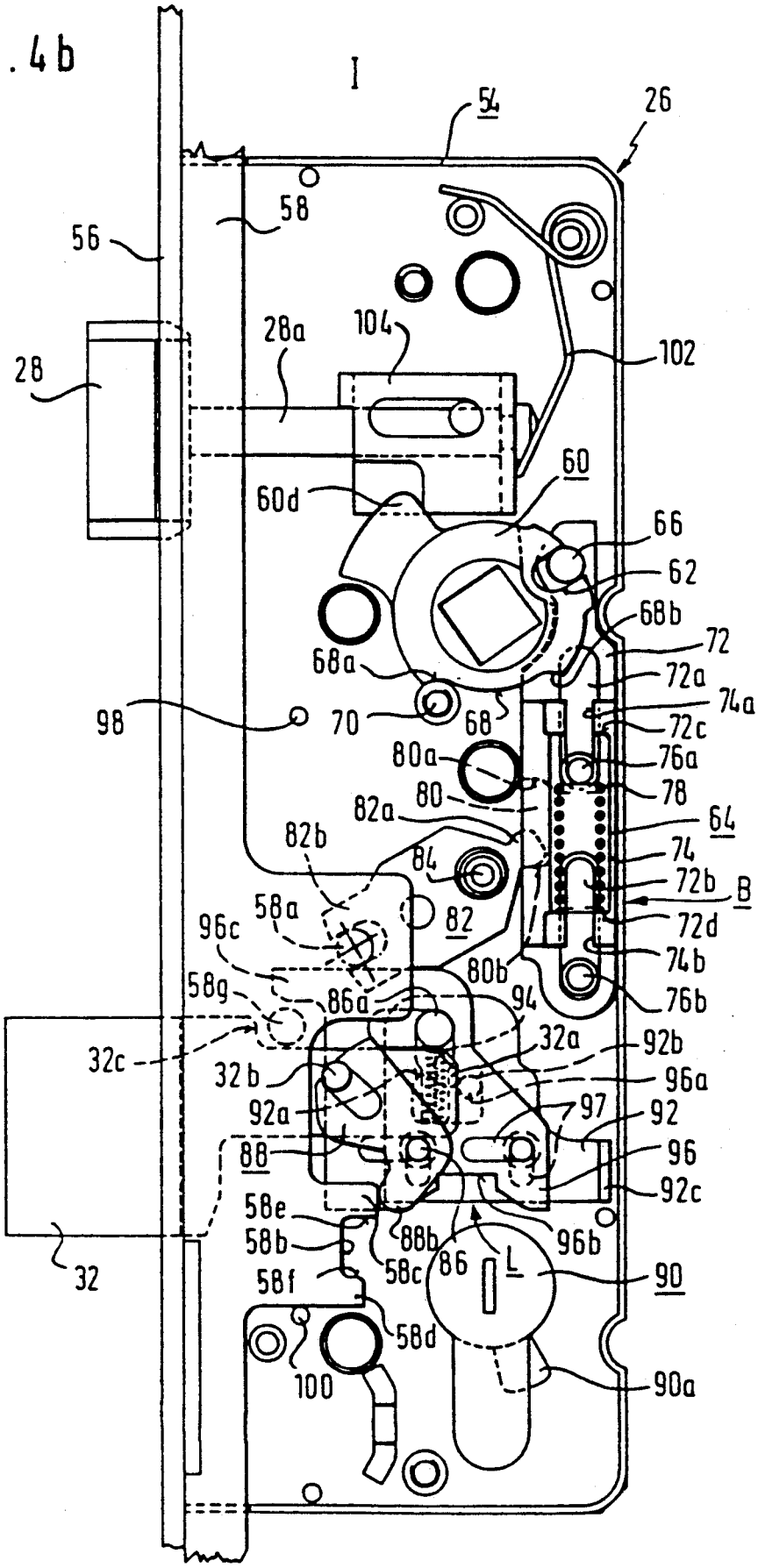
Figure 4C:
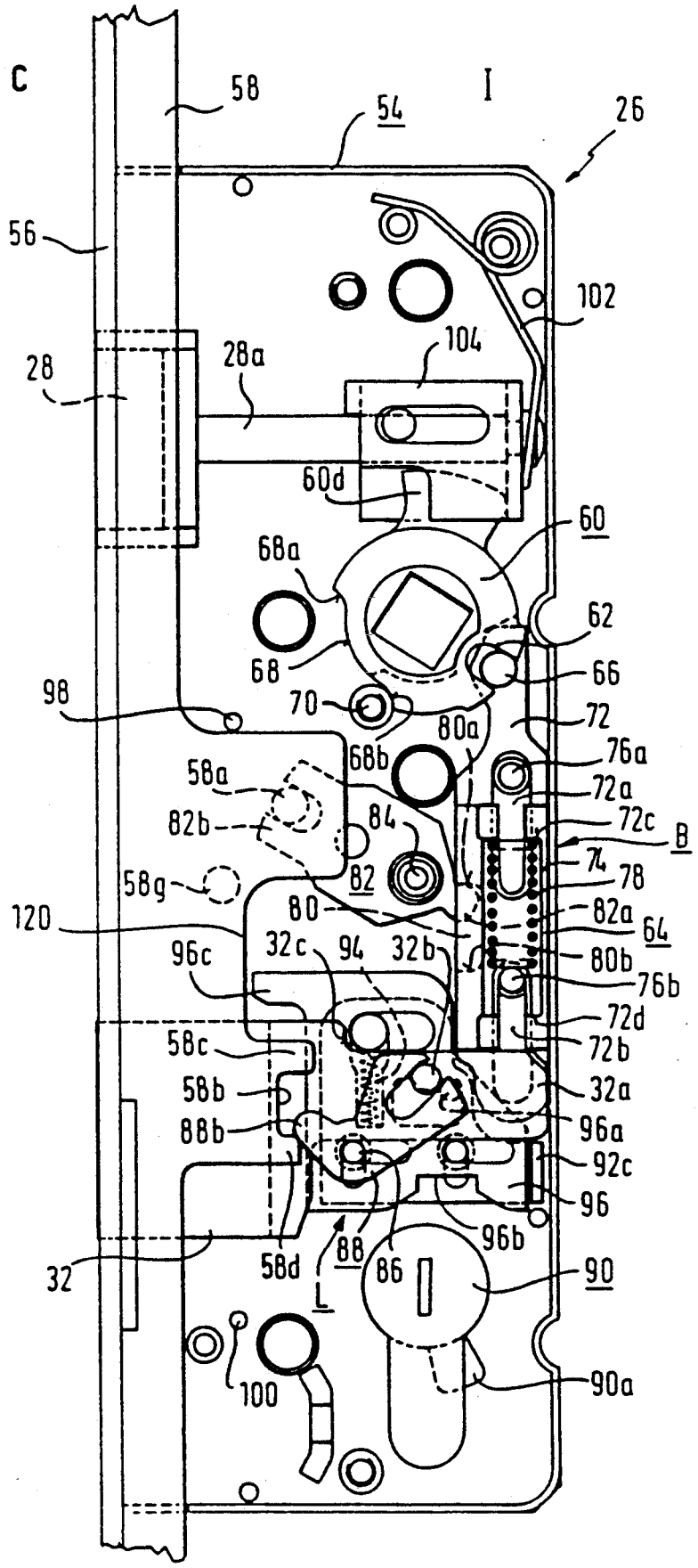

FIGS. 4*a* to *c* show in an enlarged view the construction of the first gear unit 26. Such a gear unit is known for example from European patent Application No. 89 117 141.5. The first gear unit 26 comprises a housing 54 which consists of a back plate 54*a* and, on the narrow slide, surrounding walls 54*b* to *d* and also a housing cover, not shown. On a face plate 56 which is rigidly mounted on the first leaf frame member 14*a* there is a drive rod 58 which forms the first drive rod assembly 34 which is so mounted that the narrow side of the drive rod 58 bears on the broad side of the face plate 56 in the region of the first gear unit 26 and the pivot bolt 36, 38, so that it does not impede actuation of the pivot bolt 36, 38 not of the transverse latch 28 nor of the transverse thrust bolt 32, regardless of its position. Outside the first gear unit 26 and the pivot bolts 36, 38 the flat side of the drive rod 58 bears on the face plate 56. The drive rod 58 extends thereby substantially over the entire length of the first leaf frame member 14*a*. As ill be explained in greater detail hereinafter with reference to FIG. 5, the pivot bolts 36, 38 are actuated via the drive rod 58.

For actuation of the first gear unit 26, this latter comprises actuating device B which comprises a push button follower 60 which can be rotationally rigidly coupled via a square aperture 60*a*, by means of an actuating element not shown in greater detail but such as a push button or knob. The push button follower 60 has a marginal recess 62 engaged by an entraining stud 66 fixed on a control element 64 adapted for displacement parallel with the movement of the drive rod 58. To restrict the angle of rotation of the actuating element or of the push button follower 60 there is on the push button follower 60, and extending in the peripheral direction, a further recess 68 having boundary surfaces 68*a, b* which in the extreme pivoted positions of the actuating element or of the push button follower 60 bear on an abutment stud 70 which connects the lock cover and the lock bottom 54*a*.

The control element 64 preferably consists of a carrier plate 72 guided for displacement on the housing bottom 54*a* and a spring accommodating frame 74 disposed rigidly on the carrier plate 72. The carrier plate 72 and the spring accommodating frame 74 can also be constructed in one piece by a casting process. For guiding the control element 64, there are between the housing bottom 54*a* and the housing cover two studs 76*a, b* which are at a distance from each other. The carrier plate 72 comprises two (in relation to FIG. 4*a*) vertically serially disposed longitudinal slots 72*a, b* which extend essentially in the longitudinal medium plane of the carrier plate 72 and the average distance between which corresponds to the distance between the studs 76*a, b*. The spring accommodating frame 74 is on its narrow side portion provided with a slide guide 74*a, b* engaged by the studs 76*a, b* in the horizontal neutral position of the actuating element or of the push button follower 60. The remaining narrow lateral faces form, together with the inner longitudinal faces of the frame, the spring accommodating frame 74, the frame height considered at right-angles to the plane of the drawing in FIG. 4*a* corresponds substantially to the outside diameter of a coil thrust spring 78.

The length of the slots 72*a, b* is composed of the sine of the arc between the extreme angles of rotation of the entraining stud 66 and the diameter of the stud 76*a* or 76*b*, a minimal idle travel having to be taken into account so that between the relevant extreme position of the push button follower 60 and the extreme position of the control element 64 at the same time, there is no forced movement.

What is essential is that in the inoperative position of the push button follower 60, the coil thrust spring 78 has each of its ends bearing both on the relevant stud 76*a, b* and also on abutment faces 76*c, d* of the carrier plate 72 or of the spring accommodating frame 74, so that upon a displacement of the carrier plate 72 downwardly the coil thrust spring 78 remains braced against the bottom stud 76*b* and is compressed by the abutment 72*c* while being lifted off the upper stud 76*a* and vice versa.

On the side of the control element 64 which is directed towards the interior of the housing there is a marginal recess 80 for engagement of a short lever arm 82*a* of a transmission lever 82 which has a further longer lever arm 82*b* and which is pivotally mounted on a pin member 84 rigid with the housing. The end of the shorter lever arm 82*a* of the transmission lever 82 is of approximately circular construction while the longer arm 82*b* forms a fork which engages around a stud 58*a* provided rigidly on the drive rod 58.

It is intended now to explain the way the drive rod 58 is actuated. In FIG. 4*a*, the drive rod 58 is in its (in relation to FIG. 4*a*) uppermost position, i.e. in its open position, the transverse latch 28 having been previously locked. If the push button follower 60 is pivoted in an anti-clockwise direction through 45°, then since the clearance between the circular end 82*a* and the bottom end 80*b* of the recess is so applied, the control element 64 drives the short lever arm 82*a* upwardly with the result that the drive rod 58 is at the same time displaced (in relation to FIG. 4*a*) downwardly in the direction of its closed position. The situation shown in FIG. 4*b* is then assumed. If, then, in this situation the actuating element is released and the push button follower 60 is allowed to return to the position shown in FIG. 4*a* under the action of the coil thrust spring 78, then the circular end 82*a* of the transmission lever 82 bears in clearance free fashion on the upper end face 80*a* of the recess 80 and a subsequent downwards displacement of the control element 64, as the result of a rotation of the push button follower 60 in a clockwise direction, then leads directly to a downwards movement of the circular end 82*a* and thus to an upwards movement of the drive rod 58 in the direction of its open position.

For forwards displacement of the transverse thrust bolt 32, there is pivotally mounted on a pin 86 rigid with the housing an angled lever 88 which engages over an end of the transverse thrust bolt 32 which is described as a bolt tail 32*a*. It has a bifurcated arm 38*a* which engages around a lock stud 32*b* disposed on the bolt tail 32*a* of the transverse thrust bolt 32. The other arm 88*b* of the angled lever 88 co-operates with a control profile of the drive rod 58. This control profile comprises a profile recess 58*b* and projections 58*c, d*, mutually facing profile faces 58*e, f*. If with regard to FIG. 4*a*, the drive rod 58 is displaced downwardly, then its recess 58*b* runs freely opposite the arm 88*b* of the angled lever 88 until the profiled surface 58*a* comes to bear on the arm 88*b*. Only then does forwards displacement of the transverse thrust bolt 32 commence and finally the arm 88*b* runs onto that plateau of the projection 58*c* which extends vertically in FIG. 4*a*. There is then no further displacement of the transverse thrust bolt 32, even if the drive rod 58 continues to move downwardly. In this way, the drive rod locking bolt 58*g* of the drive rod 58 can during the remaining downwards movement of the drive rod 58 engage behind a locking shoulder 32*c* of the transverse thrust bolt 32 (see FIG. 4*b*), so that pushing back of the transverse thrust bolt 32 when the transverse thrust bolt 32 is in the locked position is prevented by the bolt 58*g* which is then in its lowest position.

In the locked position of the drive rod and bolt according to FIG. 4*b*, the drive rod 58 and also the transverse thrust bolt 32 can be secured by actuation of a locking device L comprising a lock cylinder 90. For this purpose, after substantially half a turn of the lock projection 90*a* on the lock cylinder 90 in an anti-clockwise direction, firstly a tumbler 92 is cancelled out against the action of a coil thrust spring 94 and a bolt 96*a* of an auxiliary bolt 96 which is held in a niche 92*a* of the tumbler 92 is released so that upon further rotation of the lock member 90*a*, this comes to engage a recess 96*b* in the auxiliary bolt 96 and is able then to displace the auxiliary bolt 96 in a leftwards direction in relation to FIG. 4*a*. Thus displaced in a leftwards direction, a finger 96*c* on the auxiliary bolt 96 engages behind the bolt 58*g* which is rigid with the drive rod so that the drive rod 58 is locked against unauthorised displacement from the locked position upwardly in the open position (FIG. 4*b*).

Also shown in FIG. 4*b* is how the bolt 58*g* which is rigid with the drive rod moves behind the bolt shoulder 32*c* in order to prevent unauthorised retraction of the transverse thrust bolt 32 into the housing. In the pushed forward extreme left position of the auxiliary bolt 96, the pin 96*a* of the auxiliary bolt 96 is held away from the initially tensioned tumbler 92 by a further niche 92*b* so that also the auxiliary bolt 96 assumes a secured position.

It can be seen from FIGS. 4*a, b* that the auxiliary bolt 96 can only be actuated by the lock member 90*a* if the drive rod 58 and the transverse thrust bolt 32 have been previously moved into the locking position, since an angled over latch lug 92*c* disposed under the bolt tail 32*a*, bearing on the bolt tail 32*a*, prevents a lifting of the tumbler 92 so long as the transverse thrust bolt 32 is retracted. It should also be mentioned that the latch 92 and also the auxiliary bolt 96 are guided for displacement by pin-and-slot guides 97.

FIG. 4*a* shows the first gear unit 26 with a drive rod 58 in an open position. Upon actuation of the actuating element and thus of the push button follower 60 in a clockwise direction, then, the transverse latch 28 is retracted (see FIG. 4*c*) and the first leaf frame 14 can be opened. In this case, the control element 64 is displaced downwardly against the action of the coil thrust spring 78 without any torque being exerted on the transmission lever 82, since between the circular lever end 82*a* and the marginal recess 80 there is a clearance. If the actuating element is again released, then the initially tensioned control element 64 again moves upwardly in relation to FIG. 4*c* and pivots the actuating element back into the horizontal position.

Upon an actuation of the actuating element in an anti-clockwise direction through about 45°, the control element 64 is pulled upwardly in relation to FIG. 4*a* and by the circular lever end 82*a* bearing on the lower boundary face 80*b* of the marginal recess 80, the transmission lever 82 is pivoted in an anti-clockwise direction about the pin 84 and out of the position shown in FIG. 4*a* and into the position shown in FIG. 4*b*. The drive rod 58 is displaced into the closed position via the pin-and-slot connection 58*a*, 82*b*. If the actuating element is then released again, then the coil thrust spring 78 between the studs 76*a, b* results in a retropivoting of the push button follower 60 and thus of the actuating element into the inoperative position, since the coil thrust spring 78 is on the one hand braced on the stud 76*a* and on the other on the narrow side portion 72*d* of the spring accommodating frame 74. However, the transmission lever 82 remains in the pivoted position according to FIG. 4*b* due to the aforementioned idle travel between the control element 46 and the transmission lever 82.

When the drive rod 58 and the transverse thrust bolt 32 are locked by the locking arrangement L, actuation of the actuating element, i.e. a rotation of the push button follower 60 in a clockwise direction, is locked because then the end face 80*b* of the recess 80 bears on the end 82*b* of the transmission lever 82 but the lever 82 cannot be pivoted in a clockwise direction since by the pin-and-slot connection 58*a*, 82*b* it is connected to the drive rod 58 but this is locked by the auxiliary bolt 96 via the projection 96*c*. This provides a means of checking whether the locked position exists.

As FIGS. 4*a, b* show, the first gear unit 26 comprises two drive rod abutment pins 98, 100 which are amounted on the cover plate. The pin 98 limits upwards movement of the drive rod 58 and the pin 100 limits downwards movement of the drive rod 58, in relation to FIG. 4*a*.

When the first leaf frame 14 is closed against the force of a spring 102, the transverse latch 28 is automatically pushed back. To open the first leaf frame 14, the transverse latch 28 must be retracted via a cam 60*d* on the push button follower 60, a latch guide 104 and a latch tail 28*a* which is connected in one piece with the transverse latch 28.

Figure 5:
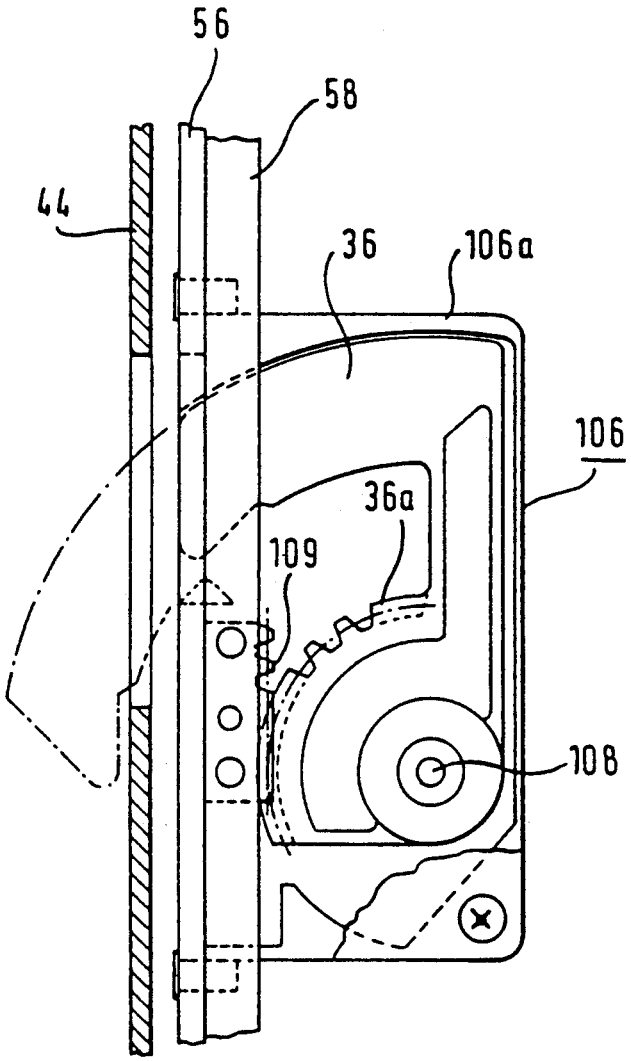
FIG. 5 is an enlarged view of a transverse bolt according to FIGS. 1*a–*3*b* disposed on the first drive rod assembly and outside the first gear unit.

FIG. 5 shows an enlarged view of the pivot bolts 36. The pivot bolt 36 is accommodated in a housing 106 with a housing bottom 106*a* which is rigidly connected to the face plate 56. The pivot bolt 36 is mounted to pivot about a journal 108 connecting the housing bottom 106*a* and the housing cover which is not shown. On that side of the drive rod 58 which is towards the housing bottom 106*a*, there is rigidly provided on the drive rod 58 a rack 109, which is fixed for instance by being riveted. The pivot bolt 36 has, concentric with the pivot axis 108, a toothed segment 36*a* which meshes with the rack 109. If the drive rod 58, in relation to FIG. 5, is displaced downwardly, then the pivot bolt 36 is pivoted leftwardly and outwardly. Accordingly, the pivot bolt 36 is swung in again upwardly by a movement of the drive rod 58.

Figure 6:
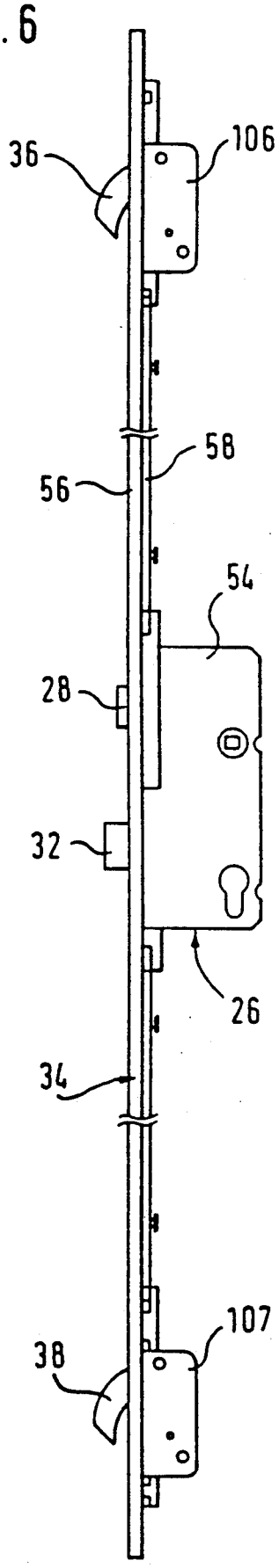
FIG. 6 is a side view of a component unit comprising the first gear unit, the first drive rod assembly and the transverse bolts according to FIGS. 2*a–*3*b* disposed outside the first gear unit.

FIG. 6 shows the first gear unit 26 together with the first drive rod assembly 34, the pivot bolts 36, 38 and the first drive rod 58 as a complete unit. The drive rod 58 and the face plate 56 can be combined into an independent assembly, which is equally true of the first gear unit 26 and the pivot bolts 36, 38 which are accommodated in its housing 106, 107. In order to be able to attach the housing 54 of the first gear unit 26 easily on the face plate 56 or the assembly consisting of the face plate 56 and drive rod 58, the housing 54 has fixing locations 54*e–g* on which the face plate 56 or the assembly consisting of face plate 56 and drive rod 58 is fixed by means of fixing elements not shown in greater detail. Attention is drawn to the fact that the fixing locations 54*e–g* in FIG. 2*a* are shown in conjunction with the second gear unit 18, since the housing 45 of the second gear unit 18 is identical to the housing 54 of the first gear unit 26.

The second gear unit 18 has for actuation of the slide members 46, 48 an actuating device B which is virtually identical to the first gear unit 26. It differs from the first gear unit 26 in that the transverse latch 28, the transverse thrust bolt 32, the lock cylinder 90, the tumbler 92 and the auxiliary bolt 96 and the elements connected directly thereto, such as for example the latch spring 102 are not present. In contrast, the second gear unit 18 does comprise the push button follower 60, the control element 64 and the transmission lever 82 which, while taking into account their mirrored-opposite disposition, are identical to the push button follower 60, the control element 64 and the transmission lever 82 of the first gear unit 26. The bifurcated end 82*b* of the transmission lever 82 engages around a stud 46*g* which is provided rigidly on the sliding member 46. Actuation of the sliding member 46, 48 via the push button follower 60, the control element 64 and the transmission lever 82 takes place in the same way exactly as has been described in connection with actuation of the drive rod 58 of the first gear unit 26 by these elements. If the push button follower 60 is pivoted in an anti-clockwise direction by a (not shown) actuating element of the second leaf frame 16, then if the first gear unit 26 is unlocked, the transmission lever 82 is pivoted out of the position shown in FIG. 2*a* and into that shown in FIG. 3*a*, so that the sliding member 46 is displaced upwardly in relation to FIG. 2*a* while the sliding member 48 is displaced downwardly in relation to FIG. 2*a* so that they occupy a position as shown in FIG. 3*a*. If the actuating element and thus the push button follower 60 are rotated in the opposite direction, the transmission lever 82 is pivoted again into the position shown in FIG. 2*a*, so that the sliding member 46 is displaced downwardly in relation to FIG. 2*a* and the sliding member 48 is displaced upwardly. The effect resulting here from the idle travel between the recess 80 and the transmission lever 82 applies here in the same way as described in connection with the first gear unit 26.

In FIGS. 4*a–c*, the first gear unit 26 comprises a lock cylinder 90 for actuation of the locking arrangement L. This embodiment of gear unit 26 is identified as I in FIGS. 2*a* and 3*a*. As emerges from FIGS. 2*a* and 3*a*, the first gear unit can, for actuating the locking device L, alternatively be supplied with a hub part 110 which likewise has lock bit which actuates the locking device L in the same way as the lock bit 90*a* of the lock cylinder 90. The hub part 110 comprises a cruciform central aperture 110*b* through which the hub part 110 can be coupled to a lock cylinder which is not shown and to a switching member. Rotation of the hub part 110 is restricted by the two abutment pins 110*a*, 110*b*. Such a hub part is already described in American CIP 529,914. This construction of locking device L can be used both in the first gear unit 26 and also in the second gear unit 18. It is described in greater detail hereinafter with reference to FIGS. 7*a*, 8, 9*a* which show an alternative to the second gear unit 18 which is shown in FIGS. 2*a*, 3*a*. This embodiment is identified as II in FIGS. 2*a*, 3*a*, 7*a*, 8 and 9*a*, whereas the embodiment which the lock cylinder 90 is identified as I in FIGS. 2*a*, 3*a*, 4*a–c* 8, 9*a*.

FIGS. 7*a* to 10*c* show a further embodiment of the locking system according to the invention. This locking system differs from the locking system according to FIGS. 2*a* to 4*c* in that the second gear unit 18 is in its essential component parts identical to the first gear unit 28. In particular, the actuating device B, the locking device L are identical to those of the first gear unit 26.

Furthermore, the second drive rod assembly 20' to a certain extent corresponds to the first drive rod assembly 34. The second gear unit 18 is therefore derived from the first gear unit 26 by omitting the transverse latch 28, the transverse latch spring 102, the latch guide 104, the transverse thrust bolt 32 and the angled lever 88. So that the spring 94 cannot jump out of its housing when the locking device L is actuated, now that the angled lever 88 is omitted, there is disposed in the locking device L in place of the angled lever 88 a cover plate 112 which is rigidly mounted on the bolt 86 which is rigid with the housing and on a further bolt 86*a* which is rigid with the housing. Instead of this fixed attachment, the cover plate 112 can also be so constructed that it fills the space between the spring 94 and the housing cover and therefore only needs to be pushed onto the bolts 86 and 86*a*.

As has already been stated at the outset, the second drive rod assembly 20' on this embodiment of locking system has been derived from the first drive rod assembly 34, in other words it is initially constructed only with one drive rod 116, corresponding to the drive rod 58 of the first drive rod assembly 34 shown in FIGS. 2*a*–4. However, as has been explained in connection with FIGS. 4*a–c*, the first drive rod assembly 34 consists of a single drive rod 58 extending over virtually the entire length of the first leaf frame member 14*a*. So that with this embodiment of locking system both drive rod end bolts 22*a*, 24*c* can engage the corresponding housings 12*c*, *d* in the transverse members 12*a*, *b* by an oppositely directed movement of the second drive rod assembly 20', it is necessary for the drive rod 116 of the second drive rod assembly 20' to be divided and provided with a reversing gear mechanism 118 (see FIGS. 7*b*, 9*b*). Thus, the second drive rod assembly 20' likewise again consists of two drive rods 116*a*, 116*b*, one of them, 116*a*, extending over virtually the entire length of the second leaf frame member 16*a* but the second drive rod 116*b* extends over just a relatively short length of the second leaf frame member 16*b*. Of course, it is also possible for the length ratios of the first drive rod 116*a* to the second drive rod 116*b* of the second drive rod assembly 20' also to be differently divided. In all cases, however, the reversing gear mechanism 118 is disposed outside the second gear unit 18.

Figure 7A:
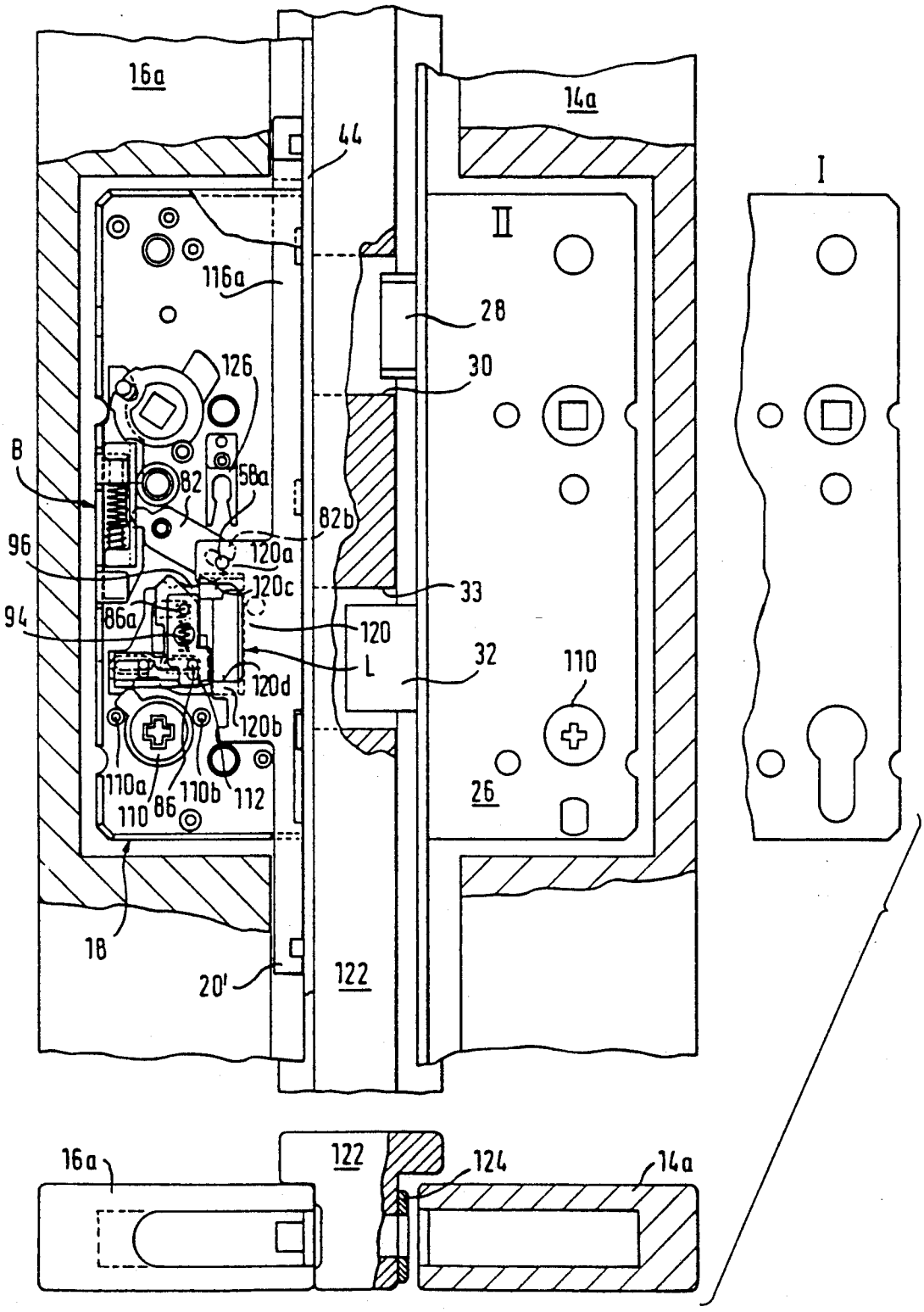
FIGS. 7*a, b* show a further embodiment of locking system according to the invention with a concealed first gear unit and an opened second gear unit as well as a first and second drive rod assembly, the first and second gear units and the first and second drive rod assemblies being shown in their locked positions.
Figure 7B:
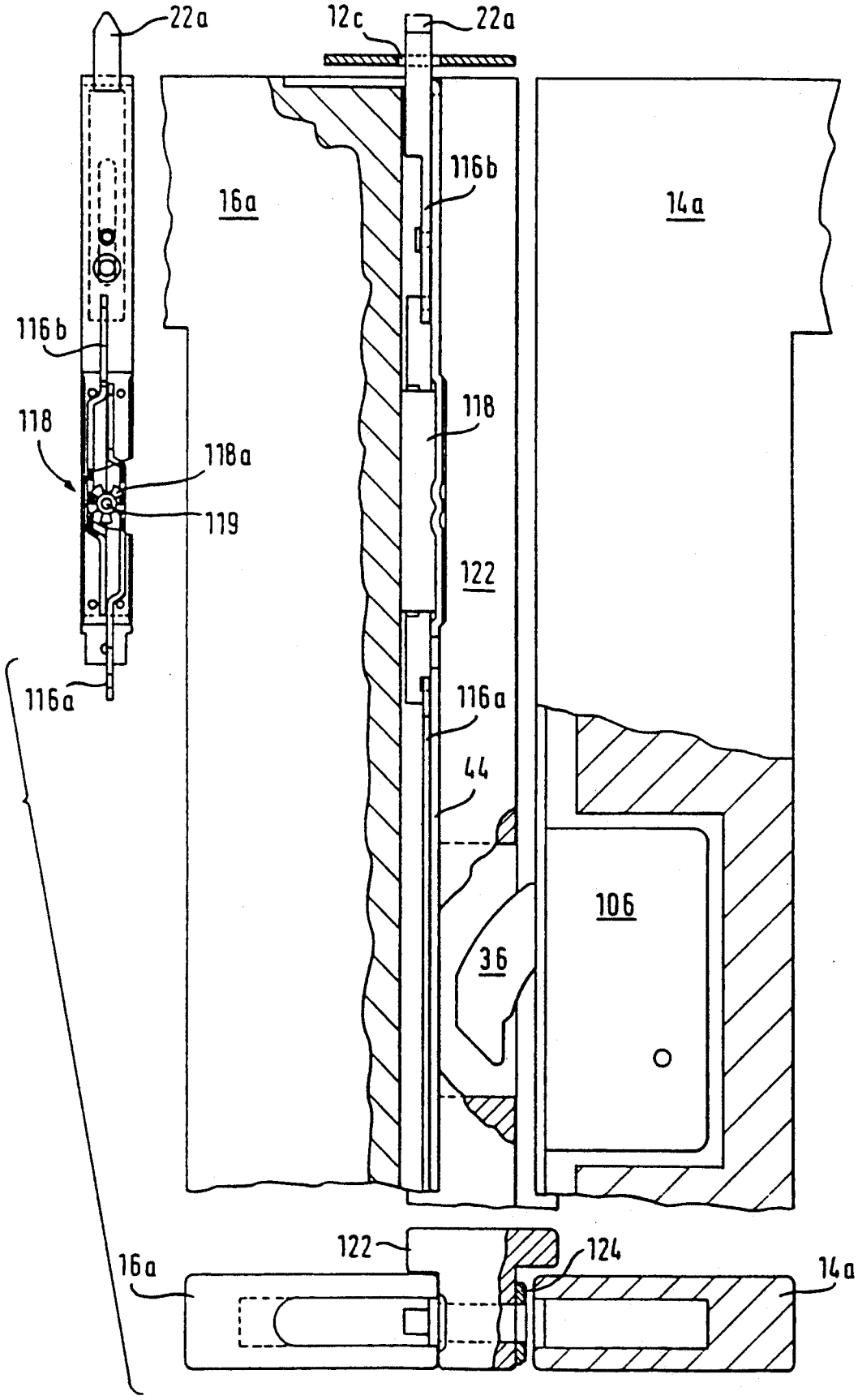

The reversing gear mechanism 118 consists essentially of a toothed element 118*a* which is mounted for rotation on a spindle 119 disposed parallel with the plane of the second leaf frame 16. The teeth of the toothed segment 118*a* engage corresponding recesses in the drive rod 116*a* and drive rod 116*b*. The drive rods 116*a*, 116*b*, in the region of the reversing gear mechanism, have their narrow sides bearing on the face plate 44. Over the remaining length of the face plate 44, the drive rods 116*a*, 116*b* of the second drive rod assembly 20' have their flat sides bearing on the face plate 44. As FIGS. 7*b* and 9*b* show, upon an actuation of the second gear unit 18, the drive rod 116*a* is for example displaced downwardly in relation to FIG. 7*a*. Consequently, the other drive rod 116*b*, due to rotation of the toothed element 118, is displaced upwardly in relation to FIG. 7*b* so that the two drive rod end bolts 22*a*, 22*a* can engage the housings 12*c*, *d* in the transverse members 12*a*, *b* of the frame 12.

In this embodiment of locking system, the second gear unit 18 likewise comprises a locking device L by means of which actuation of the drive rods 116*a*, 116*b* can be blocked. For this purpose, the drive rod 116 comprises a profiled recess 120 with two studs 120*a*, 120*b* and with two (in relation to FIG. 7*a*), vertically superimposed abutment surfaces 120*c*, 120*d*. This is the profiled recess which is also provided on the drive rod 58 shown in FIG. 4*e* where it is identified as 120 in order to illustrate the conformity. On the stud 120*a* is the bolt 58*a* which is rigid with the drive rod and around which engages the bifurcated arm 82*b* of the transmission lever 82. To block the drive rods 116*a*, 116*b*, it is first necessary to bring the drive rod 116*a* into its locked position (see FIG. 8). This is accomplished in the same way as has been described in connection with the drive rod 58 of the first gear unit 26, reference being made to FIGS. 4*a*–*c*. When the drive rod 116*a* has reached its locked position (see FIG. 7*a*), rotation of the hub part 110 in a clockwise direction results in the auxiliary bolt 96 being moved by a switching member not shown in greater detail out of the position in FIG. 7*a* into the position shown in FIG. 8, so that it is displaced rightwardly in respect of FIG. 7*a*. Consequently, the auxiliary bolt 96 engages the profiled recess 120 in the drive rod 116*a* (see FIG. 8), i.e. it bears on the stud 120*a*, *b*. The drive rod 116*a* is now locked since, if there is a movement, it abuts the surfaces 120*c*, *d* on the studs 120*a*, *b* on the auxiliary bolt 96. In order to release the drive rod 116*a*, an anti-clockwise rotation of the hub part 110 is required so that the auxiliary bolt 96 is displaced leftwardly in relation to FIG. 8 (see FIG. 8). The drive rod 116*a* is now released and can be actuated.

Figure 10A:
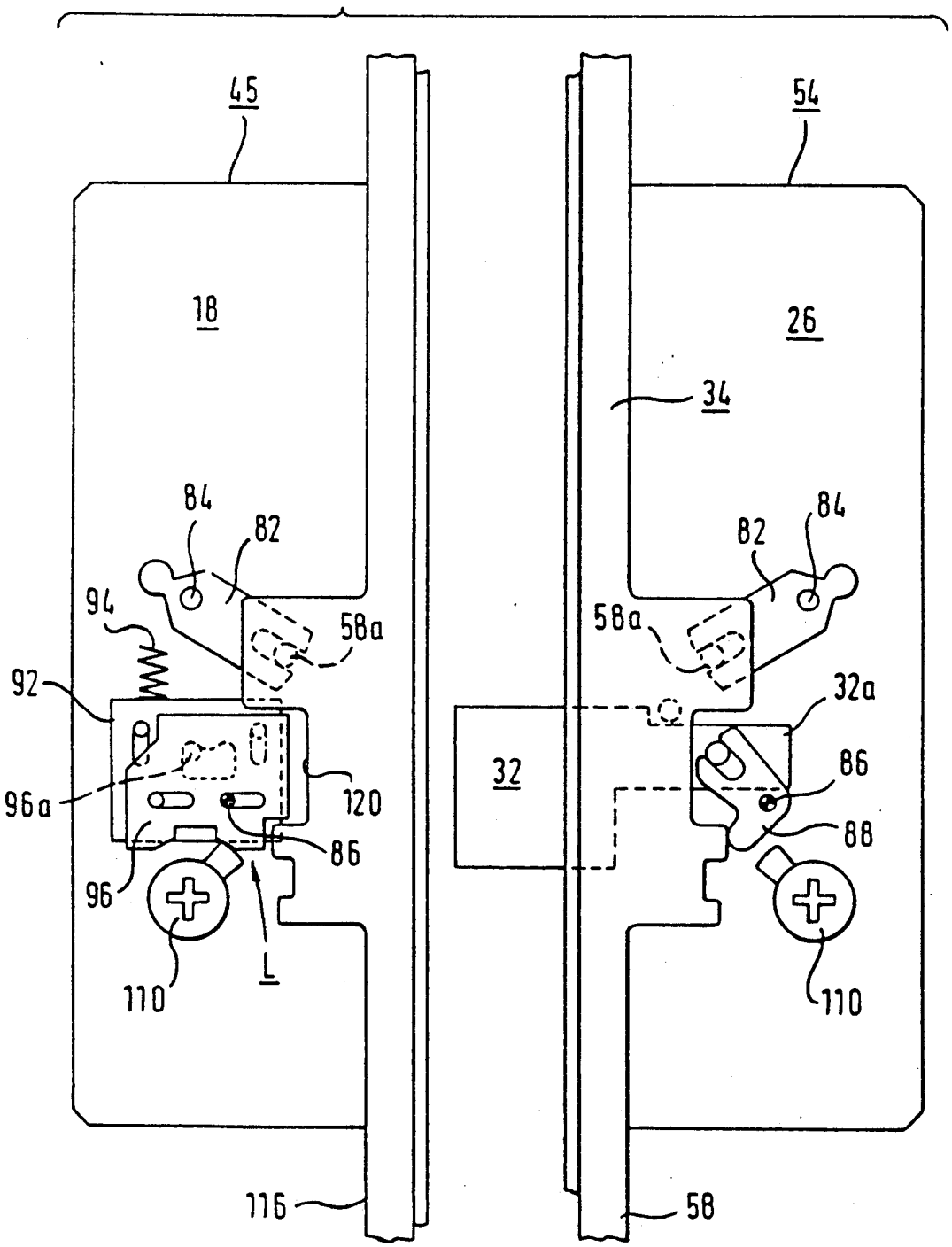
FIGS. 10*a–c* are diagrammatic views of the first and second gear units in consecutive planes.
Figure 10B:
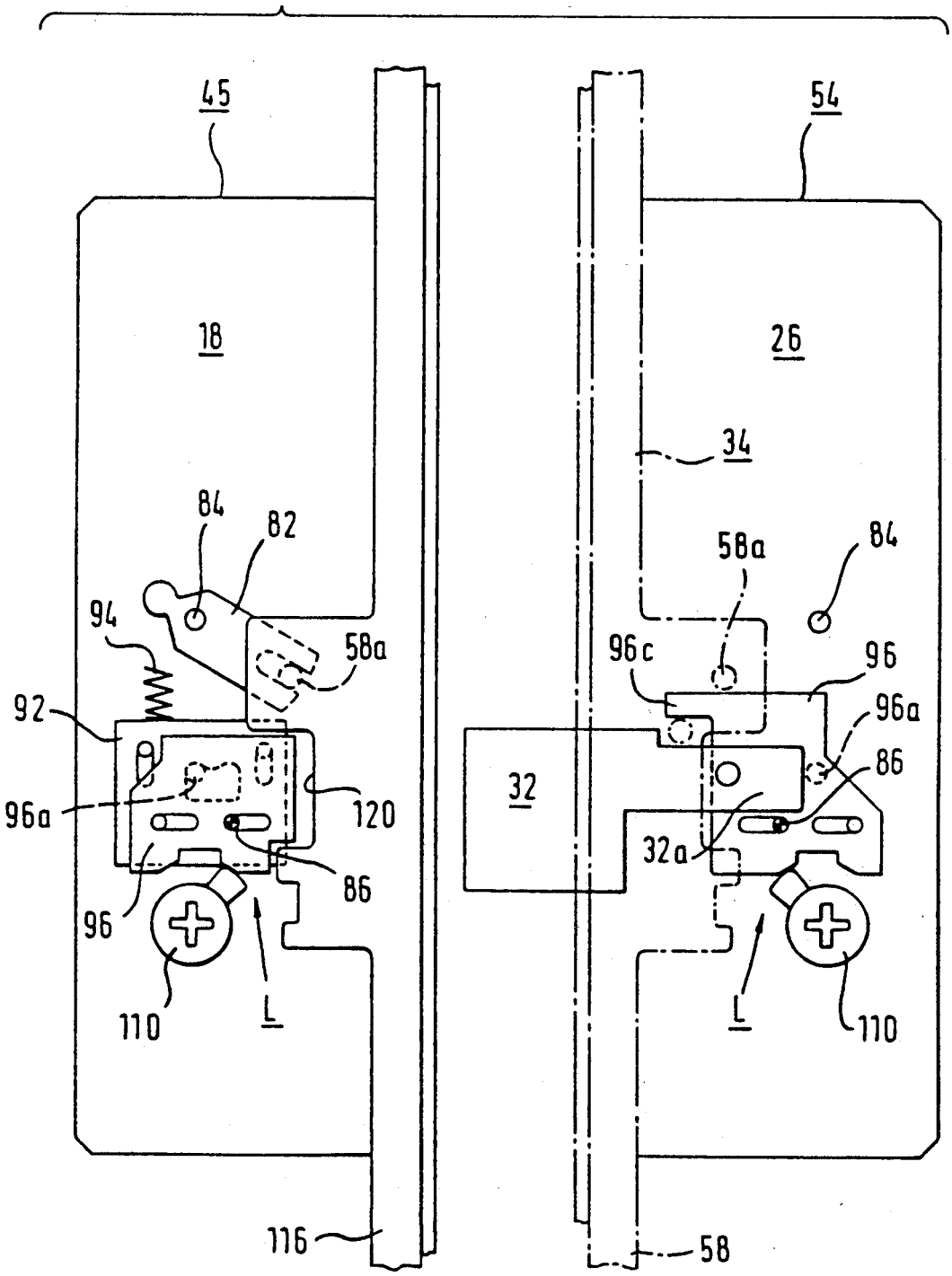
Figure 10C:
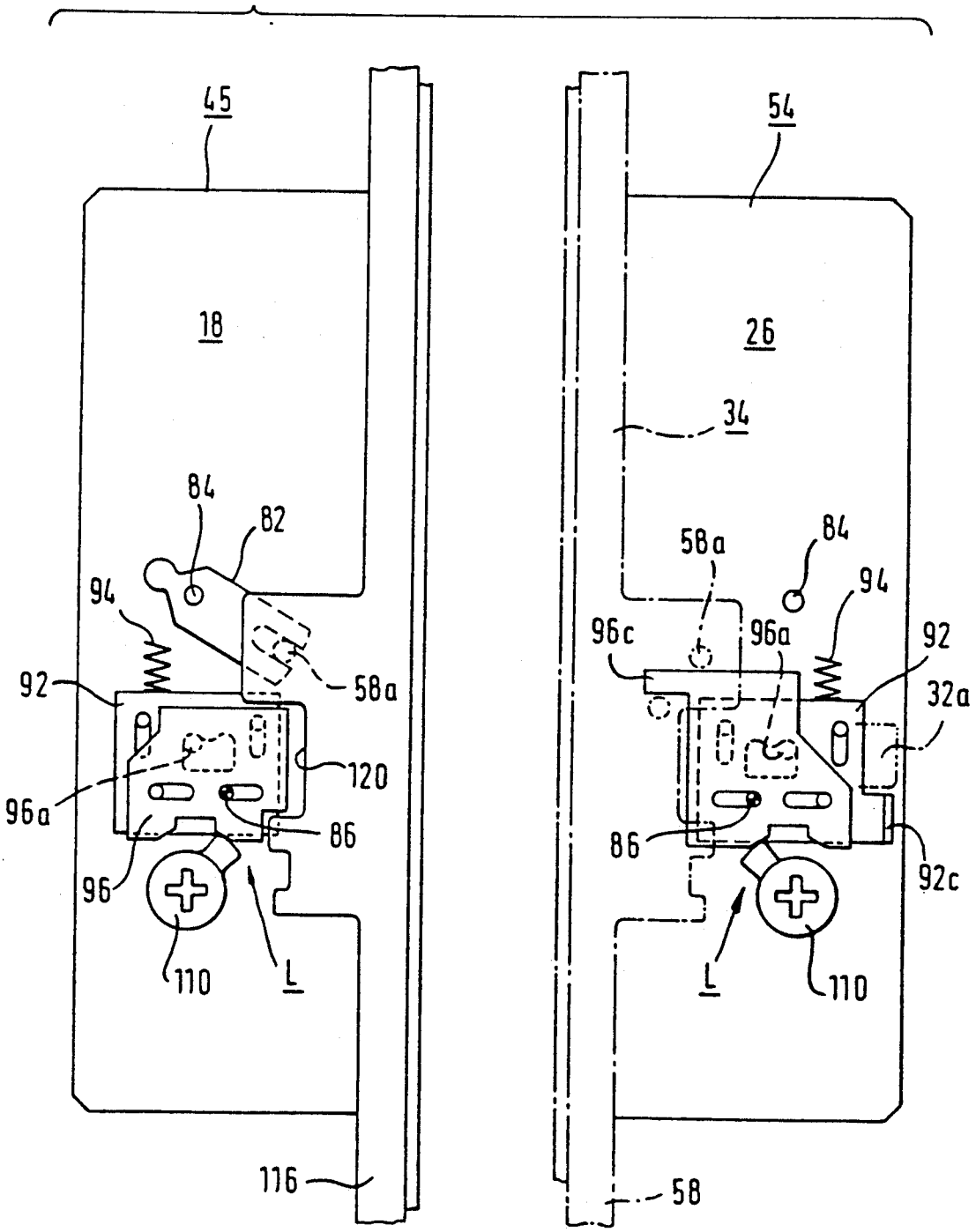

FIGS. 10*a*–*c* show how the locking device L of the second gear unit 18 is derived from the first gear unit 26. In addition, the diagrammatic construction of the locking device L is illustrated. In the right-hand half of FIGS. 10*a*–*c*, the locking device L of the first gear unit 26 is shown in various successive planes together with the drive rod assembly 34 which is illustrated partly by solid and partly by broken lines while in the left-hand half is shown the locking device L of the second gear unit 18 without any alternation. Both locking devices L are shown in the position in which they block the drive rods 34, 116. If the FIGS. 10*a*–*c* are examined one after another, it can be seen how by eliminating the transverse thrust bolt 32 and the angled lever 88 from the first gear unit 26, the locking device L of the second gear unit 18 results, together with the auxiliary bolt 96 and the tumbler 92. The auxiliary bolt 96 and the tumbler 92 of the second gear unit 18 are modified in comparison with the auxiliary bolt 96 and the tumbler 92 of the first gear unit 26 in that the finger 96*c* of the auxiliary bolt 96 is removed from the locking device L of the second gear unit 18, the auxiliary bolt 96 having in this case a greater material thickness so that the auxiliary bolt 96 of the second gear unit 18 is able to engage the profiled recess 120 in the drive rod 116 and so that the tumbler 92 of the second gear unit 18 has no lug 92*c*. The spring 94 is disposed outside the auxiliary bolt 96 only for greater clarity but in actual fact it is disposed in a recess in the auxiliary bolt 96, as can be seen in FIG. 4*a*, FIG. 10*c* also shows how there is no possibility of the locking device L being actuated in the case of the first gear unit 26 when the transverse thrust bolt 32 is inserted. In this case, the lug 92*c* of the tumbler 92 encounters the bolt tail 32*a* which is shown by dash-dotted lines.

FIGS. 10*a*–*c* likewise show that the housing 45 corresponds to the housing 54; the bolts 86 for the angled lever 88, the guide bolts for the auxiliary bolt 96, the bolts 96*a* of the auxiliary bolt 96, the studs 58*a* the drive rods 34, 116, the bolts 84 for the transmission lever 82, the transmission lever 82 itself and the hub parts 110 are also identical. Therefore, the same housing can be used for both gear units 18, 26. Also the bearing locations not shown in FIGS. 10*a*–*c* but intended for the push button follower 60 which is provided in both cases and for the actuating devices B, which are also provided in both cases (not shown in FIGS. 10*a*–*c*) are identical in the housings 45, 54. The transverse latch 28 and the transverse thrust bolt 32 are not present in the housing 45 but the bearing and guidance locations intended for them may nevertheless be present in the housing 45.

Therefore, this second embodiment of gear unit 18 is derived from the first gear unit 26, the transverse latch 28, the transverse thrust bolt 32 and the pivot bolts 36, 38 which are disposed outside the first gear unit 26 having been omitted. Accordingly, the now exposed apertures in the face plate 58 on the second gear unit 18 and on the second drive rod assembly 20 can be used as housing 30, 33, 40, 42. However, this requires a very accurate alignment of the first and second leaf frames 14, 16 in respect of each other, since the apertures or longitudinal slots 30, 33, 40, 42 in the face plate 44 are formed to very close tolerances and therefore even minimal deviations in the alignment would result in a malfunction of the locking system. In order on the one hand to be able to capitalize on the advantage of being able to derive the second gear unit from the first gear unit 26 while on the other overcoming the need for an exact alignment of the two leaf frames 14, 16, it is possible to provide on the second leaf frame 16 a strip designated an abutment strip 122 which is of a T-shaped form in cross-section (see FIGS. 7*a*–9*b*). This abutment strip 122 which is also shown in FIG. 1*b* is provided with the transverse latch housing 30 for the transverse latch 28, the transverse thrust bolt housing 33 for the transverse thrust bolt 32 and the pivot bolt housings 40, 42 for the pivot bolts 36, 38 (see FIGS. 7*a*–9*b*) . The housing 30, 33, 40, 42 for the transverse latch 28, the transverse thrust bolt 32 and the pivot bolts 36, 38 can thereby be additionally surrounded by closure plates 124 as shown for example in the bottom part of FIG. 7*a* illustrating a cross-section through the abutment strip 122. The abutment strip 122 makes it possible for the leaf frames 14, 16 to be so constructed that they have identical and smooth longitudinal edges, i.e. no steps have to be provided on the leaf frame members 14*a*, 16*a*. Thus it is possible for the leaf frames 14, 16 to be identically constructed.

If the abutment strip 122 is used, it is possible for the second leaf frame 16 to be released without first releasing the first leaf frame 14, since the transverse latch 28, the transverse thrust bolt 32 and the pivot bolts 36, 38 do not prevent a movement of the drive rods 116*a*, *b* of the second drive rod assembly 20' as was the case with the locking system shown in FIGS. 2*a*–4*c*. Conversely, then, the first leaf frame 14 can be locked without the second leaf frame 16 having first been unlocked, since the drive rods 22, 24; 116*a*, 116*b* of the drive rod assemblies 20, 20' cannot prevent engagement of the transverse latch 28, the transverse thrust bolt 32 and the pivot bolts 36, 38.

FIGS. 7*a*–9*b* further show that the first and second gear units 18, 26 and the housings 106 for the pivot bolts 36, 38 are accommodated in pockets in the relevant leaf frame 14, 16.

Figure 8:
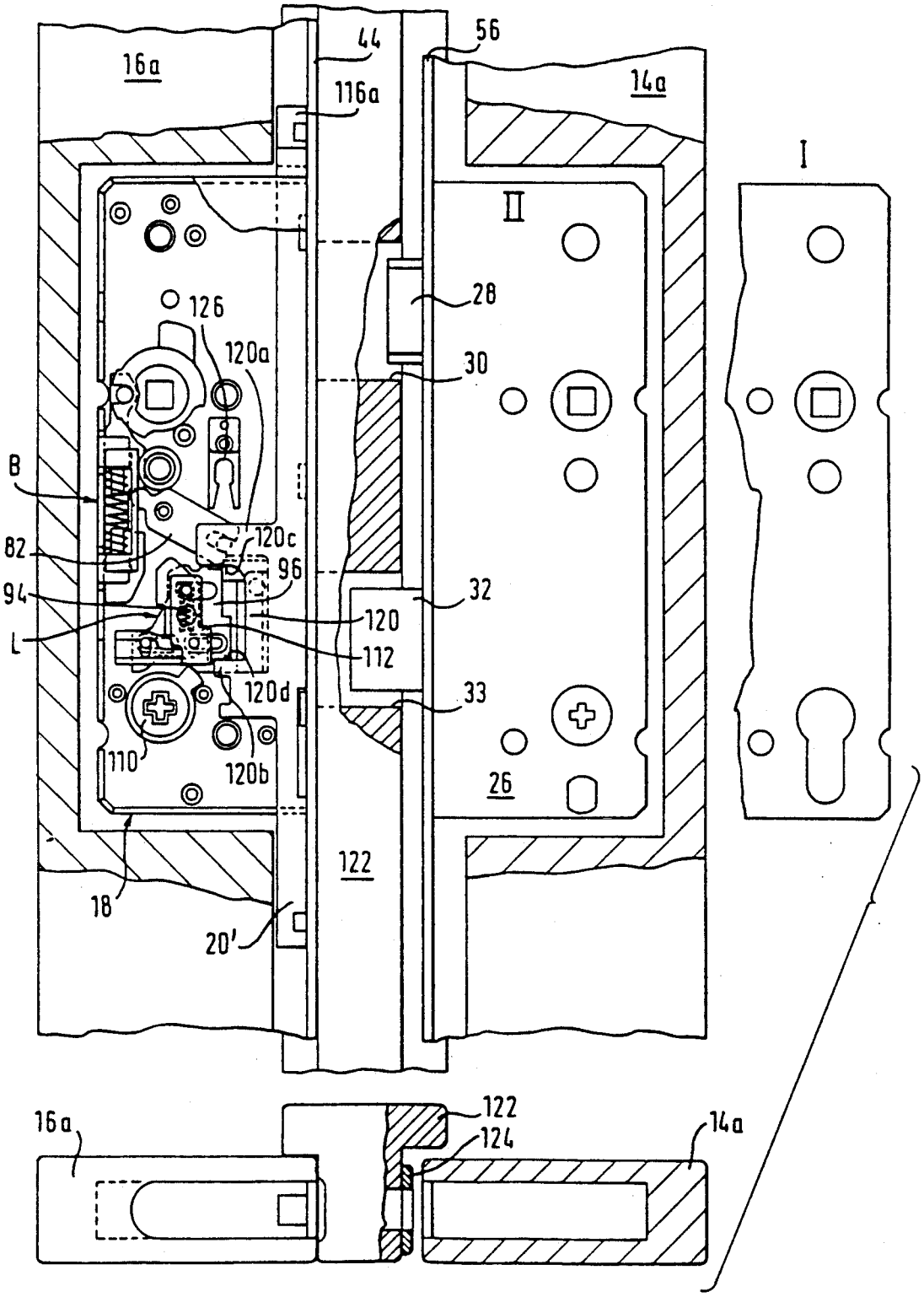
FIG. 8 is a view of the locking system according to FIGS. 7*a, b* with the second gear unit locked.
Figure 9A:
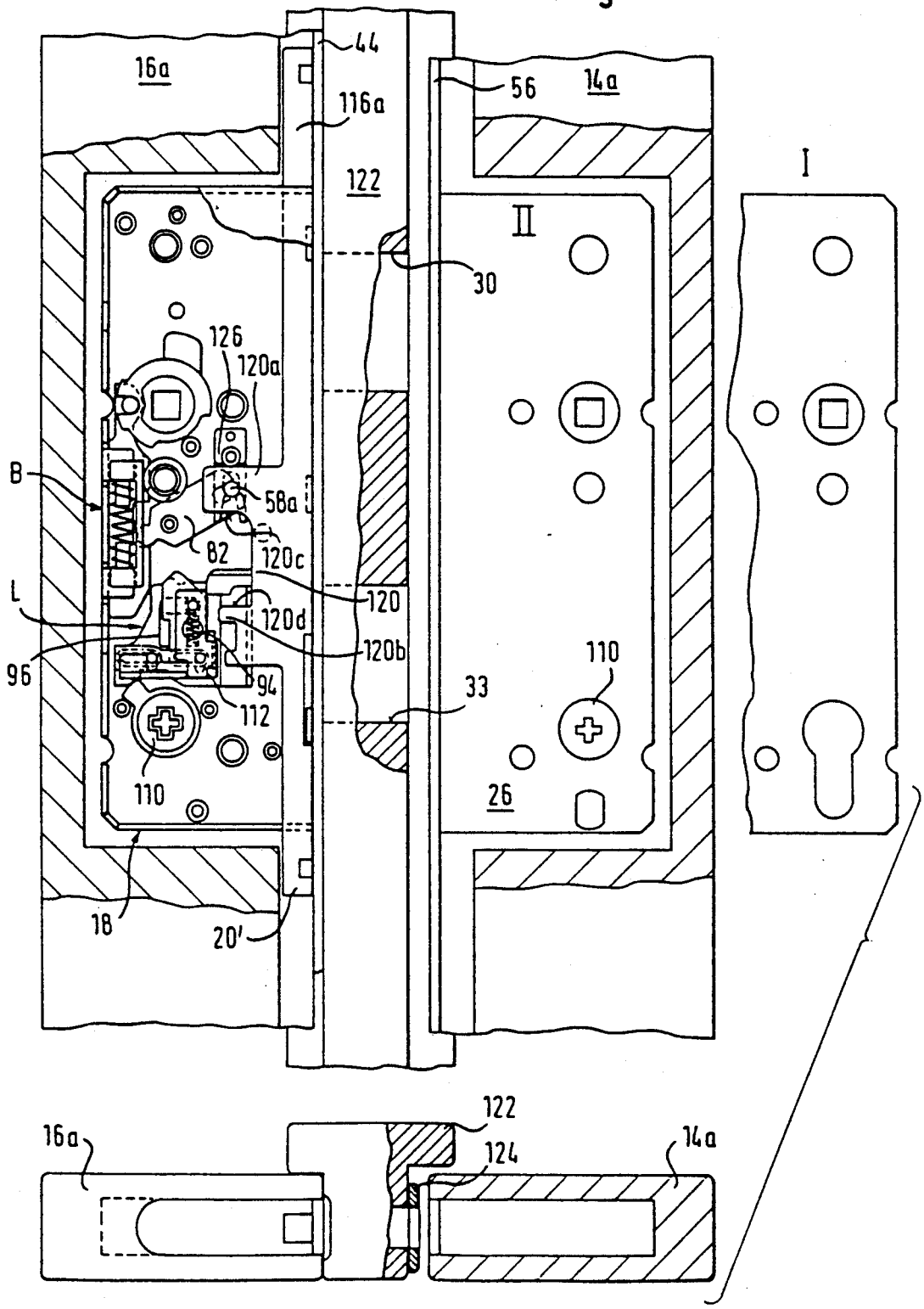
FIGS. 9*a, b* is a view of the locking system according to FIGGS. 7*a–*8, in which the first and second gear units and also the first and second drive rod assemblies are in their open position.
Figure 9B:
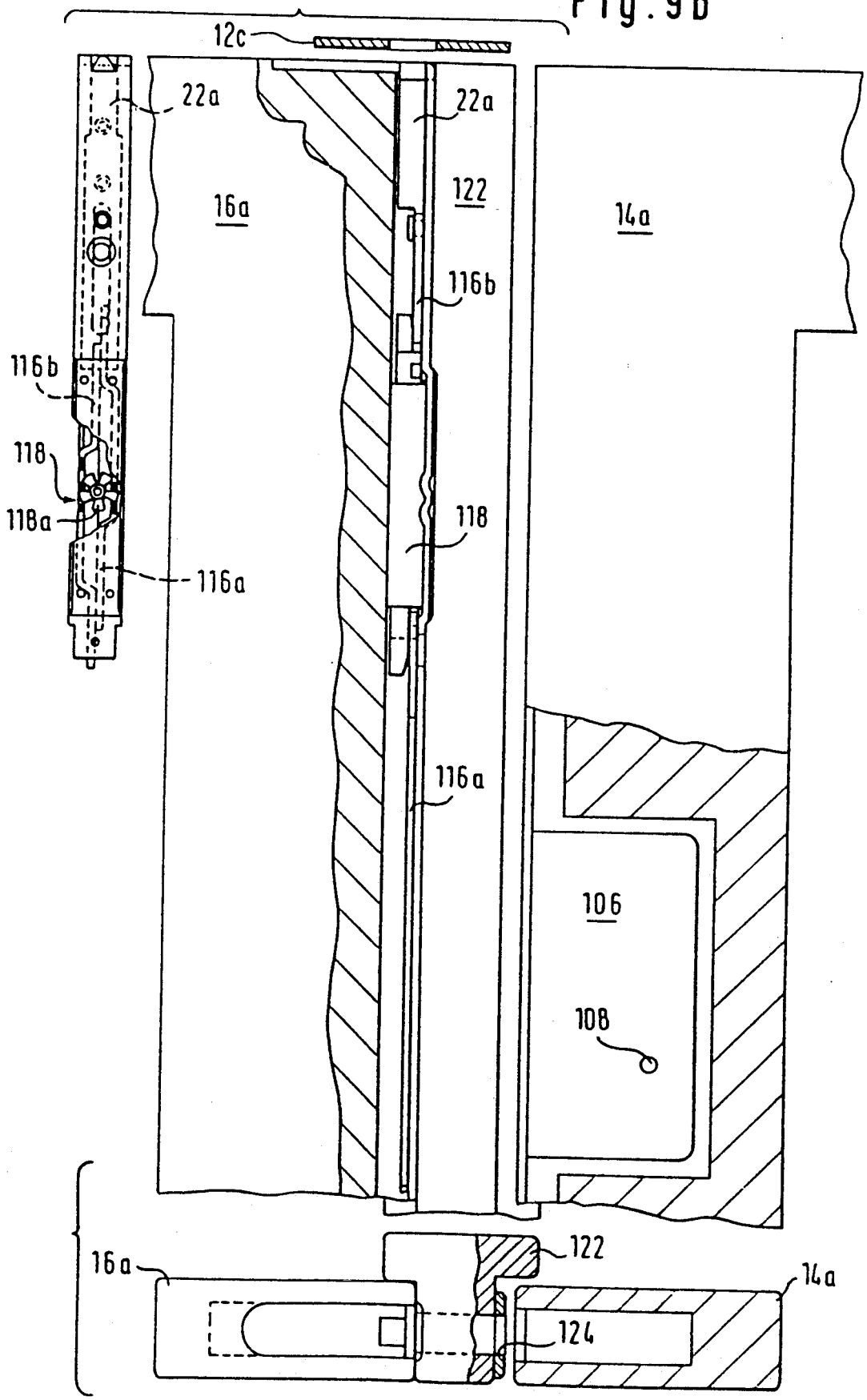

FIGS. 7*a*, 8, 9*a* further show another modification to the first and second gear units 26, 16. In order to prevent a movement of the first and second drive rod assemblies 34, 20 when these are in their released position, it is possible to provide in the first and second gear units 26, 18 a spring-loaded locking element 126 into which the pin 58*a* rigid with the drive rod engages when the drive rods 58 or 116*a*, *b* are in their released position (see FIG. 9*a*). The spring element 126 is thereby constructed as a cramp so that the bolt 58*a* which is rigid with the drive rod is held fast but can emerge from the spring element 126 upon an actuation of for example the second gear unit 18.

It should further be pointed out that in conjunction with a use of the locking system according to the invention on a door the bottom housing 12*d* for the drive rod end bolt 24*a* may also be disposed in the ground.

While specific embodiments of the invention have been shown and described in detail to illustrate the application of the invention principles, it will be understood that the invention may be embodied otherwise without departing from such principles.

The reference numerals in the claims are only used for facilitating the understanding and are by no means restrictive.

We claim:

1. A locking system for use on a window or a door, this window (10) or this door, respectively, comprising a stationary frame (12) and two leaf frames (14, 16) mounted on this frame (12) so that they pivot about mutually parallel pivot axes (S1, S2), a first leaf frame (14) of these two leaf frames (14, 16) being intended for frequent pivoting movement about a first pivot axis (S1) between an open position and a closed position, a second leaf frame (16) being intended for less frequent pivoting movement about a second pivot axis (S2) between a closed position and an open position, each of the two leaf frames (14, 16) comprising a leaf frame member (14*a*, 16*a*) remote from the respective pivot axis (S1, S2), the first leaf frame (14) having a first leaf frame member (14*a*) and the second leaf frame (16) having a second leaf frame member (16*a*), said first leaf frame member (14*a*) and said second leaf frame member (16*a*) being in the closed position of the respective leaf frames (14, 16) directly opposite each other, i.e. without the interposition of an intermediate member which is rigid with the stationary frame (12), said second frame (16) being, in the region of the second leaf frame member (16*a*), lockable by second locking means (22*a*, 22*a*) with respect to transverse members (12*a*, 12*b*) of the stationary frame (12) which extend substantially at right-angles to the first and second leaf frame members (14*a*, 16*a*), said first leaf frame (14) being lockable in the region of the first leaf frame member (14*a*) by first locking means (28, 32, 36, 38) with respect to the second leaf frame member (16*a*), said second locking means comprising, for being mounted on the second leaf frame member (16*a*) between the two transverse members (12*a*, 12*b*) a second drive unit (18), a second drive rod assembly (46, 48) for being mounted on and parallel with the second leaf frame member (16*a*) and having two second drive rod elements (22, 24) adapted for movement in opposition to each other and parallel with the second leaf frame member (16*a*) as a result of actuation of the second drive unit (18), a respective second drive rod end lock element (22*a*, 24*a*) being provided at respective ends of both said second drive rod elements (22, 24) for engagement in respective second drive rod end lock element receiver means (12*c*, 12*d*) allocated to respective transverse members (12*a*, 12*b*), said locking system further comprising a first drive unit (26) for being mounted on the first leaf frame member (14*a*) between said two transverse members (12*a*, 12*b*), said first drive unit (26) being adapted for controlling transverse latch means (28) having at least one transverse latch (28) having at least one transverse latch (28) crossing a leaf frame middle gap and engageable with latch receiving means (30) to be provided on the second leaf frame member (16*a*), said first drive unit (26) being further adapted to control transverse bolt means (32, 36, 38) which cross the leaf frame middle gap and are engageable with respective transverse bolt receiving means (33, 40, 42) to be provided on the second leaf frame member (16*a*), a first drive rod assembly (34) being provided for being fastened to said first leaf frame member, (14*a*), said first drive rod assembly (34) extending over a major part of the length of the first leaf frame member 914*a*) and being adapted for movement by the first drive unit (26) in a longitudinal direction of the first leaf frame member (14*a*), said transverse bolt means (32, 36, 38) comprising a plurality of transverse bolts (32, 36, 38), at least a part (36, 38) of said transverse bolts of said plurality of transverse bolts (32, 36, 38) being controlled via said first drive rod assembly (34) and being situated outside said first drive unit (26).

2. A locking system according to claim 1, characterised in that a drive rod controlled transverse bolts (36, 38) is constructed as pivoting transverse bolt adapted to pivot about an axis (108) which is substantially at right-angles to a main leaf plane of the first leaf frame (14).

3. A locking system according to claim 1, characterised in that the transverse bolt means (32, 36, 38) comprise at least one transverse thrust bolt (32) disposed in the region of the first drive unit (26).

4. A locking system according to claim 1, characterised in that of the transverse latch receiving means (30) and the transverse bolt receiving (33, 40, 42) at least a part is controllable by the second drive rod elements (22, 24) to enter in a condition of inability to receive the respective one of said at least one transverse latch (28) and said plurality of transverse bolts (32, 36, 38), so that in a release position of the second drive rod elements (22, 24) in which the second drive rod end lock elements (22*a*, 24*a*) are withdrawn from the second drive rod end lock element receiving means (12*c*, 12*d*), the respective ones of the transverse latch means (28) and transverse bolt means (32, 36, 38) cannot be controlled to enter the respective ones of the latch receiving means (30) and the transverse bolt receiving means (33, 40, 42).

5. A locking system according to claim 4, characterised in that second drive rod elements (22, 24) are located adjacent at least one of said latch receiving means (30) and said transverse bolt receiving means (33, 36, 38), for at least partially closing the them in said release position.

6. A locking system according to claim 1, characterised in that the first drive unit (26) and the second drive unit (18) are disposed to be aligned with each other in the direction of a connecting line (V) at right-angles to the first and second pivot axes (S1, S2).

7. A locking system according to claim 1, characterised in that the second drive unit (18) is constructed with linear motion reversing means (46, 48, 52; 118) between the two drive rod elements (22, 24).

8. A locking system according to claim 1, characterised in that the first drive rod assembly (34) comprises a single first drive rod (58) or two first always equidirectional movable drive rod elements.

9. A locking system according to claim 1, characterised in that at least the first drive unit (26) comprises a first locking arrangement (L) which permits locking of the first drive rod assembly (34) in a locked position in which the transverse latch means (28) and the transverse bolt means (32, 36, 38) have entered the latch receiving means (30) and the transverse bolt receiving means (33, 40, 42).

10. A locking system according to claim 1, characterised in that the second gear unit (26) comprises a second locking arrangement (L) which permits locking of the second drive rod assembly (20) in a locked position in which the second drive rod end lock elements (22*a*, 24*a*) are inserted into the second drive rod end lock elements receiving means (12*c*, 12*d*) of the transverse members (12*a*, 12*b*).

11. A locking system according to claim 1, characterised in that the first drive unit (26) is constructed with a housing (54), with, mounted to rotate in the housing (54) about an axis of right-angles to a main plane of the first leaf frame (14), a follower member (60) rotatable by a push button or knob, with return spring means (78) which tension the follower member (60) into a rest position so that it can be rotated in opposite directions out of said rest position, with said first drive rod assembly (34) which is guided along a face plate (56) of the housing (54) and with, connecting the follower member (60) to the first drive rod assembly (34), a transmission linkage (72, 82) which is subject to backlash and which includes a transmission lever (82) and which is intended for displacement of the first drive rod assembly (34), rotation of the follower member (60) in a first direction of rotation serving to displace the first drive rod assembly (34) into a locked position and rotation of the follower member (60) in a second direction of rotation serving to displace the first drive rod assembly (34) into an open position, the backlash in the transmission linkage (72, 82) after entering a respective drive rod position of said locked position and said open position permitting, upon release of the push button or knob, a return of the follower member (60) to its rest position by the return spring means spring (78), leaving the first drive rod assembly (34) in whichever position of said locked position and said open position had been reached, said transmission linkage (72, 82) further comprising a control element (64) which is guided in the vicinity of, opposite the face plate (56), a boundary edge (54*c*) of the housing (54) parallel with the first drive rod assembly (34), this control element (64) being furthermore coupled in substantially clearance free manner to the follower member (60), the return spring (78) further engaging the control element (64), the transmission lever (82) being constructed as a two-armed transmission lever (82) which is mounted on the housing (54) at a midway location between the first drive rod assembly (34) and the control element (64), a first shorter lever arm (82*a*) engaging the control element (64) with backlash and a longer lever arm (82*b*) engaging the first drive rod assembly (34), said follower member (60) acting on said at least one transverse latch (28) of the transverse latch means which is tensioned by a latch spring (102) towards a closing position, said first drive rod assembly (34) further being coupled to a transverse thrust bolt (32) which is guided for displacement at right-angles to the face plate (56) in the housing (54) and which is adapted for movement between a closing position corresponding to the locked position of the first drive rod assembly (34) and a retracted position corresponding to the open position of the first drive rod assembly (33), a first locking arrangement (L) being provided which makes it possible to block displacement of the first drive rod assembly (34) out of its locked position into its open position.

12. A locking system according to claim 11, characterised in that the second drive unit (18) is derived from the first drive unit (26) while retaining the housing (54), the associated face plate (56), the follower member (60), the return spring (78), the control element (64) and the transmission lever (82) and while avoiding the transverse latch (28) and the transverse thrust bolt (32), the transmission lever (82) engaging one of the two second drive rod elements (116*a*, 116*b*), this one second drive rod element being connected to the other second drive rod element by linear motion reversing means (46, 48, 52; 118).

13. A locking system according to claim 12, characterised in that the liner motion reversing means (118) are provided outside the second drive unit (18).

14. A locking system according to claim 12, characterised in that openings (30, 33) in the face plate (44) of the second drive unit (18) which are not filled due to said avoiding of the transverse latch (28), and the transverse thrust bolt (32) are used as receiving means (30, 33) for the transverse latch (28) and the transverse thrust bolt (32) of the first gear unit (26).

15. A locking system according to claim 12, characterised in that matching face plates (56, 44) are associated with the first drive rod assembly (34) and the second drive rod assembly (20), respectively, pivot bolt throughways being provided in the face plate (56) allocated to the first drive rod assembly (34) and being occupied by pivoting transverse bolts (36, 38), further throughways (40, 42) being provided in the face plate (44) allocated to the second drive rod assembly (20), these further throughways not occupied by pivoting transverse bolts (36, 39) and serving as bolt receiving means for the pivoting transverse bolts (36, 38) allocated to the first drive rod assembly (34).

16. A locking system according to claim 1 characterised in that the first and the second drive unit (26, 18) are each separably connected to a respective face plate-drive rod assembly.

17. A locking system according to claim 1, characterised in that an edge face of the second leaf frame (16) which is opposite to the first leaf frame (14) is combined with or adapted to be combined with a bolt engagement strip (122), said bolt engagement stops being provided with bolt receiving means (33, 40, 42) and latch receiving means.

18. A locking system according to claim 17, characterised in that the bolt engagement strip (122) is provided with engagement plates (124) for the engagement of respective pivoting transverse bolts (36, 38).

19. A locking system for use on a window or a door, this window (10) or this door, respectively, comprising a stationary frame (12) and two leaf frames (14, 16) mounted on this frame (12) so that they pivot about mutually parallel pivot axes (S1, S2), a first leaf frame (14) of these two leaf frames (14, 16) being intended for frequent pivoting movement about a first pivot axis (S1) between an open position and a closed position, a second leaf frame (16) being intended for less frequent pivoting movement about a second pivot axis (S2) between a closed position and an open position, each of the two leaf frames (14, 16) comprising a leaf frame member (14*a*, 16*a*) remote from the respective pivot axis (S1, S2), the first leaf frame (14) having a first leaf frame member (14*a*) and the second leaf frame (16) having a second leaf frame member (16*a*), said first leaf frame member (14*a*) and said second leaf frame member (16*a*) being in the closed position of the respective leaf frames (14, 16) directly opposite each other, i.e. without the interposition of an intermediate member which is rigid with the stationary frame (12), said second leaf frame (16) being, in the region of the second leaf frame member (16*a*), lockable by second locking means (22*a*, 24*a*) with respect to transverse members (12*a*, 12*b*) of the stationary frame (12) which extend substantially at right-angles to the first and second leaf frame members (14*a*, 16*a*) said first leaf frame (14) being lockable in the region of the first leaf frame member (14*a*) by first locking means (28, 32, 36, 38) with respect to the second leaf frame member (16*a*), said second locking means comprising, for being mounted on the second leaf frame member (16*a*) between the two transverse members (12*a*, 12*b*), a second drive unit (18) for controlling said second locking means (22*a*, 24*a*), said first locking means comprising a first drive unit (26) for being mounted on said first leaf frame member (14*a*) between said two transverse members (12*a*, 12*b*), said first drive unit (26) being adapted for controlling at least one lock member (28, 32, 36, 38) of said first locking means movably mounted on said first leaf frame member (14*a*) for crossing a leaf frame middle gap and being engaged with lock member receiving means (30, 33, 40, 42) to be provided on the second leaf frame member (16*a*), said lock member receiving means (30, 33, 40, 42) being controllable by said second drive unit (18) to enter into a condition of inability to receive said at least one lock member (28, 32, 36, 38) in a release position of said second drive unit (18) in which said second leaf frame (16) is unlocked with respect to said transverse members (12*a*, 12*b*).

* * * * *